US007927102B2

(12) United States Patent
Jones et al.

(10) Patent No.: US 7,927,102 B2
(45) Date of Patent: Apr. 19, 2011

(54) SIMULATION DEVICES AND SYSTEMS FOR ROCKET PROPELLED GRENADES AND OTHER WEAPONS

(75) Inventors: Giles D. Jones, Pomona, CA (US); Quang K. Ha, El Monte, CA (US); Lee Ourn, Riverside, CA (US); Samon Jannati, Diamond Bar, CA (US)

(73) Assignee: Raytheon Company, Waltham, MA (US)

( * ) Notice: Subject to any disclaimer, the term of this patent is extended or adjusted under 35 U.S.C. 154(b) by 490 days.

(21) Appl. No.: 11/330,902

(22) Filed: Jan. 12, 2006

(65) Prior Publication Data

US 2007/0026364 A1 Feb. 1, 2007

Related U.S. Application Data

(60) Provisional application No. 60/643,701, filed on Jan. 13, 2005.

(51) Int. Cl.
*F41A 33/00* (2006.01)

(52) U.S. Cl. ..... 434/11; 434/19; 434/20; 434/21

(58) Field of Classification Search ..... 434/19–23
See application file for complete search history.

(56) References Cited

U.S. PATENT DOCUMENTS 4,014,262 A 3/1977 Betts
4,326,847 A * 4/1982 Roe ..... 434/12
4,416,630 A * 11/1983 Hagen et al. ..... 434/16
4,447,211 A * 5/1984 Kern et al. ..... 434/12
4,464,974 A * 8/1984 Goda ..... 89/41.06
4,945,541 A 7/1990 Nakayama
5,095,433 A * 3/1992 Botarelli et al. ..... 273/372
5,194,007 A * 3/1993 Marshall et al. ..... 434/21
5,235,127 A 8/1993 Findley
5,351,429 A * 10/1994 Ford ..... 42/115
5,474,452 A 12/1995 Campagnuolo (Continued)

OTHER PUBLICATIONS

PEO STRI, One Team. Fight. Training Future, PEOSTRI Program Guide, www.military-training-technology.com/PDF/2006_PEO_STRI.PDF, 16 pages.

(Continued)

*Primary Examiner* — Xuan M Thai
*Assistant Examiner* — Robert J Utama
(74) *Attorney, Agent, or Firm* — Daly, Crowley, Mofford & Durkee, LLP

(57) ABSTRACT

A rocket propelled grenade (RPG) simulation device usable with a laser detector is provided. The RPG simulation device comprises a laser transmitter, a switch, a controller, and a housing. The laser transmitter is capable of directing a laser signal to the laser detector, the laser signal comprising information readable by the laser detector, to simulate a launch of a rocket propelled grenade from the RPG simulation device to the laser detector. The switch permits a user to trigger a laser signal from the laser transmitter. The controller is in operable communication with the laser transmitter and the switch, and the controller is operable to respond to triggering of the switch and to simulate the launch of a rocket propelled grenade by directing the laser transmitter to generate and transmit a laser signal. The RPG simulation device can further comprise an anti-tank weapons effect systems simulator (ATWESS) in operable communication with the controller, the ATWESS generating an indicator replicating a physical effect (such as noise, a visual effect, a gaseous effect, muzzle flash, smoke, an audible effect, and/or a blast sound) that occurs when an RPG launches a grenade.

14 Claims, 16 Drawing Sheets

U.S. PATENT DOCUMENTS

| | | | | |
|---|---|---|---|---|
| 5,477,557 | A | 12/1995 | Inaba et al. | |
| 5,481,979 | A | 1/1996 | Walder | |
| 5,788,500 | A | 8/1998 | Gerber | |
| 5,936,986 | A | 8/1999 | Cantatore et al. | |
| 6,065,404 | A | 5/2000 | Ripingill, Jr. et al. | |
| 6,254,394 | B1 | 7/2001 | Draper et al. | |
| 6,386,879 | B1 | 5/2002 | Varshneya et al. | |
| 6,422,145 | B1 | 7/2002 | Gavrilovic et al. | |
| 6,449,892 | B1 * | 9/2002 | Jenkins | 42/1.01 |
| 6,450,817 | B1 | 9/2002 | Deinlein | |
| 6,579,097 | B1 | 6/2003 | Sampson et al. | |
| 6,599,127 | B1 | 7/2003 | Hopmeier et al. | |
| 6,616,452 | B2 | 9/2003 | Clark et al. | |
| 6,638,070 | B1 * | 10/2003 | Healy et al. | 434/22 |
| 6,771,679 | B2 | 8/2004 | Schie | |
| 6,814,667 | B2 | 11/2004 | Jeffway, Jr. et al. | |
| 7,001,182 | B2 | 2/2006 | Lazecki et al. | |
| 7,507,089 | B2 | 3/2009 | Jones et al. | |
| 7,545,287 | B2 | 6/2009 | Feldman et al. | |
| 2003/0027103 | A1 | 2/2003 | Preston et al. | |
| 2004/0096806 | A1 | 5/2004 | Davidsson et al. | |
| 2009/0263765 | A1 | 10/2009 | Jones et al. | |

OTHER PUBLICATIONS

Improvised explosive device, Wikipedia, Jul. 2006, http://en.wikipedia.org/wiki/Improvised_explosive_device, 4 pages.

Military Training Technology, Online Edition, Replicating a Grim Reality, www.military-training.com/print_article.cfm?DocID=664, Jul. 2006, 4 pages.

Multiple Integrated Laser Engagement System Shoulder Launched Munitions (MILES SLM), U.S. Army PEO STRI, 1 page, Jun. 5, 2006, www.peostri.army.mil/PRODUCTS/MILES_SLM.

Peo Stri Awards $18 Million Contract for the Multiple Integrated Laser Engagement Simulation (Miles) Shoulder Launched Munitions, U.S. Army Peo Stri, 1 page, Jul. 27, 2006, www.peostri.army.mil/PAO/pressrelease/MILES_SLM.jsp.

Simulation Projects, Shoulder Launched Munitions (SLM), 4 pages Jul. 27, 2006, www.unitech1.com/solutions_sim_p2.htm.

DefenseLINK News: Arrival Sets Tone for Civic Leader's Fort Bliss Visit, United States Department of Defense, Oct. 17, 2005, 4 pages.

M-72 Light Anti-tank Weapon (LAW), FAS Military Analysis Network, Dec. 20, 2005, 4 pages.

OSI Defense Systems, Our Products, Training Systems, Oct. 17, 2005, 7 pages.

Titan Dynamics Systems, Inc., Training the way you fight!, Rocket Propelled Grenade System (RPGS),Oct. 17, 2005, 1 page.

Cubic Defense Applications, Ground Combat Training Systems, Miles 2000, Components/After Action Reviews, Field Maintenance Reports, "Firing Devices & Pyrotechnics", www.cubic.com, 2004, 1 page.

Cubic Defense Applications, Ground Combat Training Systems, Miles 2000, Components/After Action Reviews, Field Maintenance Reports, "Individual Weapon System", www.cubic.com, 2004, 1 page.

Cubic Corporation, Newsroom, "Cubic to Support Improvised Explosive Device (IED) Training As Part of Winning Contractor Team" www.cubic.com, 2004, 2 pages.

UXOINFOcom, The Authority on Unexploded Ordinance Technology, News, and Information, MOTIS Category-Pyrotechnics, "Simulator Launching, Anti-Tank, Guided Missile and Rocket, M22", www.uxoinfo.com, Jan. 1994, 2 pages.

TM 09-1265-368-10-3, Operator's Manual, Multiple Integrated Laser Engagement System (Miles), Simulator System, Firing Laser: M68 (NSN 1265-01-077-6079) for Viper Rocket, Distribution Statement A. Approved for public release; distribution is unlimited. Headquarters, Department of the Army, Jul. 1988, www.scribd.com, 39 pages.

Exhibit A for Response to Office Action dated May 14, 2010. PDI Technology, Services & Products, Laser Diode Driver EML2010D, www.waybackmachine.com, Apr. 16, 2003, 2 pages.

Exhibit B for Response to Office Action dated May 14, 2010. Lasemate Group, Diode Driver Circuit Boards, Models of Diode Driver Circuit Boards, www.waybackmachine.com, Oct. 11, 2003, 3 pages.

Exhibit C for Response to Office Action dated May 14, 2010. Intersil Corporation, Laser Diode Driver w/Waveform Generator, www.waybackmachine.com, Jul. 7, 2004, 2 pages.

Exhibit D for Response to Office Action dated May 14, 2010. Directed Energy, Inc., Laser Diode Drivers and Current Sources, www.waybackmachine.com, Feb. 6, 2003, 3 pages.

Exhibit E for Response to Office Action dated May 14, 2010. Army Research Laboratory, An Implementation of the Multiple Integrated Laser Engagement System (MILES) on an Unmanned Ground Vehicle (UGV), www.waybackmachine.com, Mar. 1996, 30 pages.

Exhibit F for Response to Office Action dated May 14, 2010. FAS, Military Analysis Network, Multiple Integrated Laser Engagement System (MILES), www.waybackmachine.com, Aug. 7, 1999, 2 pages.

Exhibit G for Response to Office Action dated May 14, 2010. Multiple Integrated Laser Engagement System, Miles 2000, Training Device Operational Requirements Document for Replacement of Ground Direct Fire Tactical Engagement Simulation (TES) Devices Cards No. 0291, www.waybackmachine.com, Revision Jul. 1996, 9 pages.

File downloaded for U.S. Appl. No. 11/535,969, filed Sep. 27, 2006 file through Oct. 12, 2010, PART 1, 300 pages.

File downloaded for U.S. Appl. No. 11/535,969, filed Sep. 27, 2006 file through Oct. 12, 2010, PART 2, 300 pages.

File downloaded for U.S. Appl. No. 11/535,969, filed Sep. 27, 2006 file through Oct. 12, 2010, PART 3, 300 pages.

File downloaded for U.S. Appl. No. 11/535,969, filed Sep. 27, 2006 file through Oct. 12, 2010, PART 4, 302 pages.

File downloaded for U.S. Appl. No. 12/356,156, filed Jan. 20, 2009 file through Oct. 12, 2010, 387 pages.

File downloaded for U.S. Appl. No. 12/356,569, filed Jan. 21, 2009 file through Oct. 12, 2010, 386 pages.

* cited by examiner

View A-A

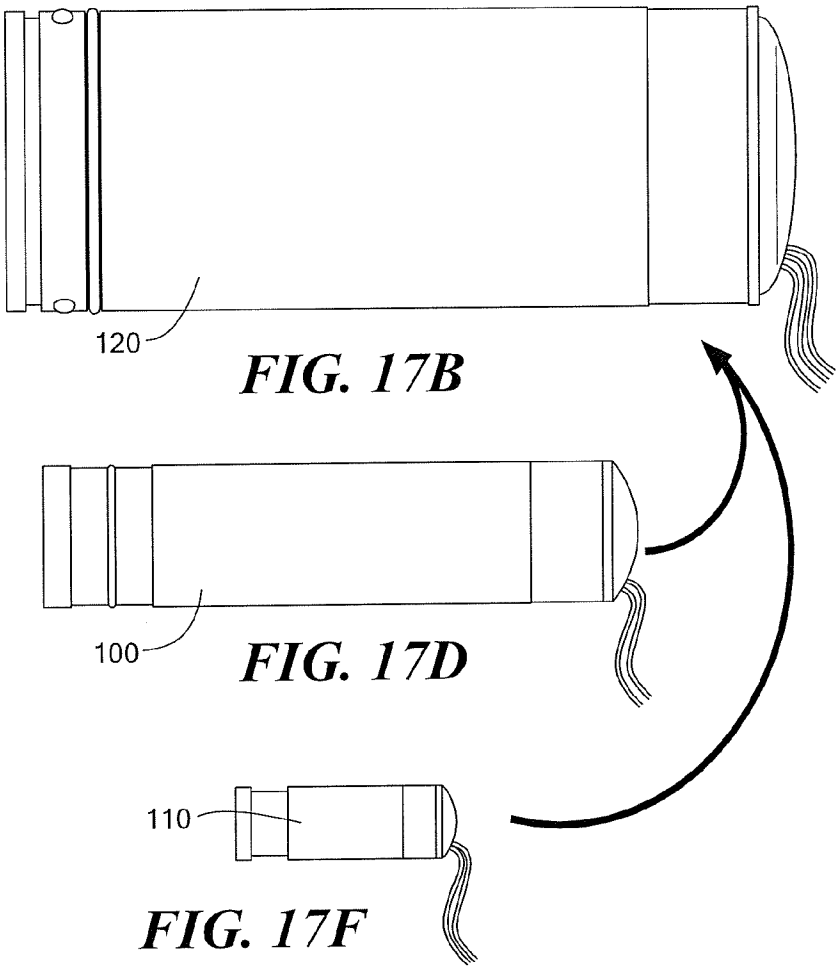
FIG. 17B
FIG. 17D
FIG. 17F
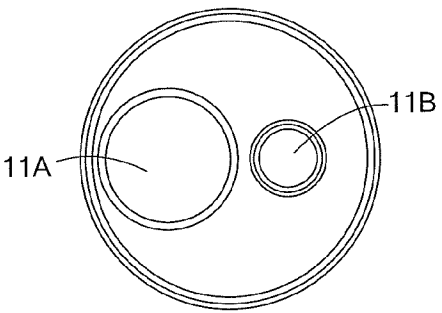
FIG. 17A
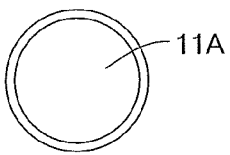
FIG. 17C
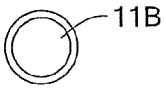
FIG. 17E

SIMULATION DEVICES AND SYSTEMS FOR ROCKET PROPELLED GRENADES AND OTHER WEAPONS

CROSS-REFERENCE TO RELATED APPLICATIONS

This application claims the priority of U.S. Provisional Application No. 60/643,701 entitled "Rocket Propelled Grenade, Variant II" filed Jan. 13, 2005, the contents of which are incorporated herein by reference in their entirety.

STATEMENT REGARDING FEDERALLY SPONSORED RESEARCH

This invention was made with Government support under Contract N61339-00-D-0001 with the Department of the Navy. The Government has certain rights in this invention.

FIELD OF THE INVENTION

Embodiments of the invention generally relate to devices, systems, and methods for simulating the operation and effect of various weapons, especially explosive weapons, during military training exercises. More particularly, the invention relates to devices, systems and methods for simulating the operation and effect of weapons such as rocket propelled grenades (RPG's) in a laser-based battle simulation environment

BACKGROUND OF THE INVENTION

At present, in live battlefield military operations in areas such as the Middle East, opposing forces using weapons such as the rocket-propelled-grenade (RPG) are presenting a significant threat to U.S. military forces stationed there. In an RPG weapon, a relatively small rocket charge is mounted in a tube, together with a grenade, which can then be aimed and launched at a target. One example of a commercially available RPG device is the RPG-7, which has been manufactured in a number of countries, including Russia and various Eastern European countries such as Romania, over its forty-plus year history. FIG. 1 is an illustration showing a prior art Russian-made RPG-7 antitank grenade launcher 2 ("RPG 2"). The RPG 2 is a recoilless, shoulder-fired, muzzle-loaded, reloadable weapon, capable of firing an 85-mm (PG-7) or 70-mm (PG-7M) rocket-assisted High Explosive Anti Tank (HEAT) grenade from a 40-mm smoothbore launcher tube. Features of the RPG 2 include a flared blast shield 3 (which also serves as the breech through which the charge can be loaded). The charge is provided to initially launch the grenade assembly from the firing tube. 3, a telescope optical sight 4, an iron sight 5, a heat shield 6 (which in this illustration is made of an insulating material such as wood), a trigger 7, a grenade 8, such as the PG-7VM grenade, and include a pair of hand grips 9A, 9B. The RPG 2 is light enough (around 15 pounds) to be carried and fired by one person.

With the RPG 2, launch of the grenade 8 is typically via a gunpowder booster charge (not visible in FIG. 1) at about 115 m/s, and this launch creates a cloud of light bluish grey smoke (which typically puffs out in the vicinity of the blast shield 3. It is the sight of this smoke that is often the only warning (i.e., a visual indicator) that a potential target has alerting the target that the RPG 2 has been fired. After the grenade 8 such as the 70 mm PG-7M is fired from the RPG 2, the PG-7M's internal rocket motor will ignite after the grenade 8 has traveled about 10-11 meters, giving the grenade 8 higher velocity, a relatively flat trajectory, and better accuracy. In addition, when the grenade round exits the tube of the RPG 2, several sets of fins 8A at the rear of the grenade round 8 unfold, to maintain direction and induce rotation. The maximum effective range of the RPG 2 is about 500 meters for stationary targets and 300 meters for moving targets, with a maximum overall range of about 920-1100 meters, at which point the grenade 8 will self destruct (typically about 4-5 seconds after it was launched). The fuse sets the maximum range of the grenade 8. One way the timed detonation of the RPG 2 has been used is to create rough proximity airbursts against targets such as helicopters once the targets have passed the preferred 100 meter "head-on attack" zone. In addition, some grenades used with the RPG 2 can penetrate armor up to 330 millimeters.

Although the RPG 2 generally won't travel as far as a larger rocket, the RPG 2 is far more portable (it can be held over a shoulder), lightweight, simple to use (literally "point and shoot") and, unlike indirect weapons such as mortar, can be more directly aimed at a target, to produce damage essentially equivalent to a stick of dynamite detonated at the target location. Further, because the blast radius of anti-armor round fired by an RPG 2 is around 4 to 8 meters, personnel and/or equipment in proximity to an RPG blast will still experience significant negative effects from it. For example, personnel may experience effects such as temporary deafness and blindness from an RPG blast even if such persons are not permanently harmed or killed by the blast.

Because the RPG 2 is so simple to use, effective, damaging, and widely available, it has become the weapon of choice for many forces around the world, including many guerilla armies and insurgents hostile to U.S. interests. Consequently, the U.S. military has great interest in training its personnel to deal with military combat situations in which RPGs may be used.

One way that the U.S. military trains its forces to deal with various military combat situations is using laser-based combat simulation systems. Such laser-based systems have been developed to simulate military combat situations without actually having to fire live ammunition. These systems use relatively low power lasers and matched detectors for indicating when a "hit" has occurred. One such system is the Multiple Integrated Laser Engagement Systems, referred to as the MILES system. Military forces in the U.S. and around the world have found MILES to be an important tool to help soldiers and others learn combat survival skills and evaluate battle outcomes, and MILES training has been proven to dramatically increase the combat readiness and fighting effectiveness of military forces.

An illustrative implementation of MILES uses so-called eye-safe "laser bullets," combined with the use of laser sensitive detectors, to simulate battlefield situations. Each individual and vehicle in the training exercise has a detection system to sense hits and perform casualty assessment. For example, as part of an exemplary MILES event, some soldiers are equipped with one or more laser detectors (e.g., an optical detector) capable of receiving a coded laser signal or pulse that has been fired, and these laser detectors can be attached to the soldier himself, to a vehicle the solder is riding on or in, or to any other location proximate to a target of interest. Other soldiers are equipped with laser transmitters capable of "shooting" coded laser signals and/or pulses of infrared energy. These laser transmitters can be readily attached to and detached from any location, person, or thing (e.g., vehicle mounted weapons, hand carried weapons, vehicles, tanks, etc.). In some implementations, one or more of the coded laser signals and/or pulses are modulated to indicate the type of weapon that is the source of the laser beam; and a soldier identification number may also be included in the transmitted signal.

When the laser sensitive detectors receive the coded laser signal/pulse(s), one or more MILES decoders determine whether the target was hit and, if so, whether the "laser bullet" was accurate enough to cause damage (e.g., a casualty). This determination can be made in various ways, such as by whether the coded signals/pulses exceed a threshold, whether the coded signals/pulses actually hit its intended target, and the like. In some implementations, the target (and/or the shooter) can be made aware almost instantly of the accuracy of a simulated shot, such as by audible alarms, visible displays, pyrotechnics, and the like, where these indicators can designate a hit or near miss and also help to provide realism for the soldiers.

In more recent implementations of MILES, all action by shooters and targets (deemed "players") is recorded during a simulated event, so that a so-called After Action Review (AAR) can occur later, to review the effectiveness of the weapons and/or of the defenses against them. For example, one implementation of AAR allows commanders to process, format and view engagement data collected during an exercise, for review after the exercise. In addition, exercise data can be archived for future use, such as to provide additional training for military forces.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

In one embodiment, to help mitigate the threat of devices such as RPGs, the invention provides a surrogate training device simulating an RPG, where the training device is usable with a laser-based system such as the MILES system. The surrogate training device, which simulates the RPG (minus the launch of an actual grenade at a target) provides a simulation of predetermined characteristics of the RPG, such as the aesthetics (e.g., "look and feel"), weight, appearance, and physical features, such as the muzzle flash (e.g., an incandescent flash at a weapon muzzle following departure of the arms being used, which can be caused be the ignition of oxygen, the expulsion of burning powder grains and the expansion of powder gasses), smoke trail and sounds that occur when a grenade is launched from an actual RPG.

In one embodiment, the invention provides a rocket propelled grenade (RPG) simulation device usable with a laser detector, the RPG simulation device comprising a laser transmitter, a switch, a controller, and a housing. The laser transmitter is capable of directing a laser signal to the laser detector, the laser signal comprising information readable by the laser detector, to simulate a launch of a rocket propelled grenade from the RPG simulation device to the laser detector. The switch permits a user to trigger a laser signal from the laser transmitter. The controller is in operable communication with the laser transmitter and the switch, and the controller is operable to respond to triggering of the switch and to simulate the launch of a rocket propelled grenade by directing the laser transmitter to generate and transmit a laser signal. The housing simulates at least one predetermined characteristic of an actual RPG device. The housing is constructed and arranged to house at least one element selected from the group consisting of the laser transmitter, the switch, and the controller.

The laser signal can comprise a pulse of laser energy. The RPG simulation device can further comprise an anti-tank weapons effect systems simulator (ATWESS) in operable communication with the controller, the ATWESS generating an indicator replicating a physical effect that occurs when an RPG launches a grenade. When the switch is triggered, the controller can command the ATWESS to generate the indicator replicating the physical effect. For example, the indicator can comprise at least one physical effect selected from the group consisting of a noise, a visual effect, a gaseous effect, muzzle flash, smoke, an audible effect, and a blast sound.

The RPG simulation device can further comprise a display in communication with the controller, wherein the display is constructed and arranged to display information related to operation of the RPG to an operator of the RPG. For example, the displayed information can comprise at least one piece of information selected from the group consisting of round count, player identification number, laser power level, rounds remaining, weapon type, and battery level. In addition, the RPG simulation device can include indicators capable of indicating to a user that a laser signal has been transmitted and/or capable of enabling alignment of the laser transmitter.

In one embodiment, the laser transmitter can transmit a laser signal encoded with a MILES code, such as a code recognizable by a MILES-type detector. In one embodiment, the controller can perform additional operations, such as one or more of tracking number of rounds fired; tracking a player identification number, tracking a power level of a laser signal emitted by the laser transmitter; tracking a battery level; generating a programmable hit and near miss word, adjusting a power level of the laser signal emitted by the laser transmitter; adjusting an alignment of the laser signal emitted by the laser transmitter; generating a signal to control the laser signal where the laser signal further comprises a MILES code; tracking MILES code related information in a laser signal that comprises a MILES code; receiving an instruction from an external system via a USB port; providing data to an external system via a USB port; providing information to a display; providing reverse voltage protection; responding to a controller key; responding to a push to read switch; responding to a magnetic switch; responding to a trigger switch; and responding to a safety switch.

In another embodiment, the invention provides a method for simulating operation of a rocket propelled grenade (RPG). A physical structure having at least one predetermined characteristic in common with an actual RPG is provided. A laser transmitter is coupled to the physical structure, the laser transmitter operable to direct a laser signal to a laser detector. A user-accessible control is provided on the physical structure. The laser transmitter is coupled to the user-accessible control so as to enable a user to transmit a laser signal towards a target to simulate launching an RPG at that target. In a further aspect, an anti-tank weapons effect system simulator (ATWESS) is provided, where the ATWESS is capable of generating an indicator simulating a physical effect that occurs when an actual RPG launches a grenade. In still a further aspect, the laser signal can be encoded with a MILES code.

In one aspect, a physical effect is generated when the laser signal is transmitted, the physical effect comprising at least one physical effect selected from the group consisting of sound, muzzle flash, smoke, visual effect, audio effect, and gaseous effect.

In another embodiment, the invention provides a system usable with a detector responsive to a laser signal for simulating the operation of a rocket propelled grenade (RPG) device. The system comprises means for enabling a user to trigger a simulated launch of a grenade from the RPG device; means for directing a laser signal to the detector in response to the simulated launch trigger; and means for generating a physical indicator of the launch. In a further embodiment, the system further comprises means for simulating at least one predetermined characteristic associated with the operation of the RPG device, the at least one predetermined characteristic selected from the group consisting of sound, muzzle flash, smoke, weight, color, shape, housing material, length, range, visual effect occurring when weapon is fired, audio effect occurring when weapon is fired, and gaseous effect occurring when the weapon is fired.

Details relating to this and other embodiments of the invention are described more fully herein.

BRIEF DESCRIPTION OF THE DRAWINGS

The advantages and aspects of the present invention will be more fully understood in conjunction with the following detailed description and accompanying drawings, wherein:

FIGS. 17A and 17B are front and side views, respectively, of the dual function laser tube used with the RPG simulation device of FIG. 2; and FIGS. 17C and 17D are front and side views, respectively of a the first laser tube used with the dual function laser tube of FIGS. 17A and 17B; and FIGS. 17E and 17F are front and side views, respectively, of the second laser tube used with the dual function laser tube of FIGS. 17A and 17B.

In the drawings, like reference numbers indicate like elements. The drawings are not to scale, emphasis instead being on illustrating the principles of the invention.

DETAILED DESCRIPTION

Throughout this document, the term "rocket propelled grenade" (RPG) is used to describe a particular type of weapon being simulated. However, those of skill in the art will recognize that at least some embodiments of the invention are equally applicable to weapons such as rifle-propelled grenades, light anti-tank weapons (LAWs), artillery, mortar, grenades, and rockets. For example, the physical appearance of the RPG simulation device can readily be adapted to match the physical appearance of a weapon such as rifle propelled grenade, light anti-tank weapon, etc., and the physical effects (e.g., sights and sounds) that occur when the respective weapon is used can also be incorporated as part of the simulation device. In addition, note that the term "rocket propelled grenade" is a term of art that refers at least to a weapon that launches a grenade using a rocket, and not merely to the grenade itself that is being launched.

Figure 2:
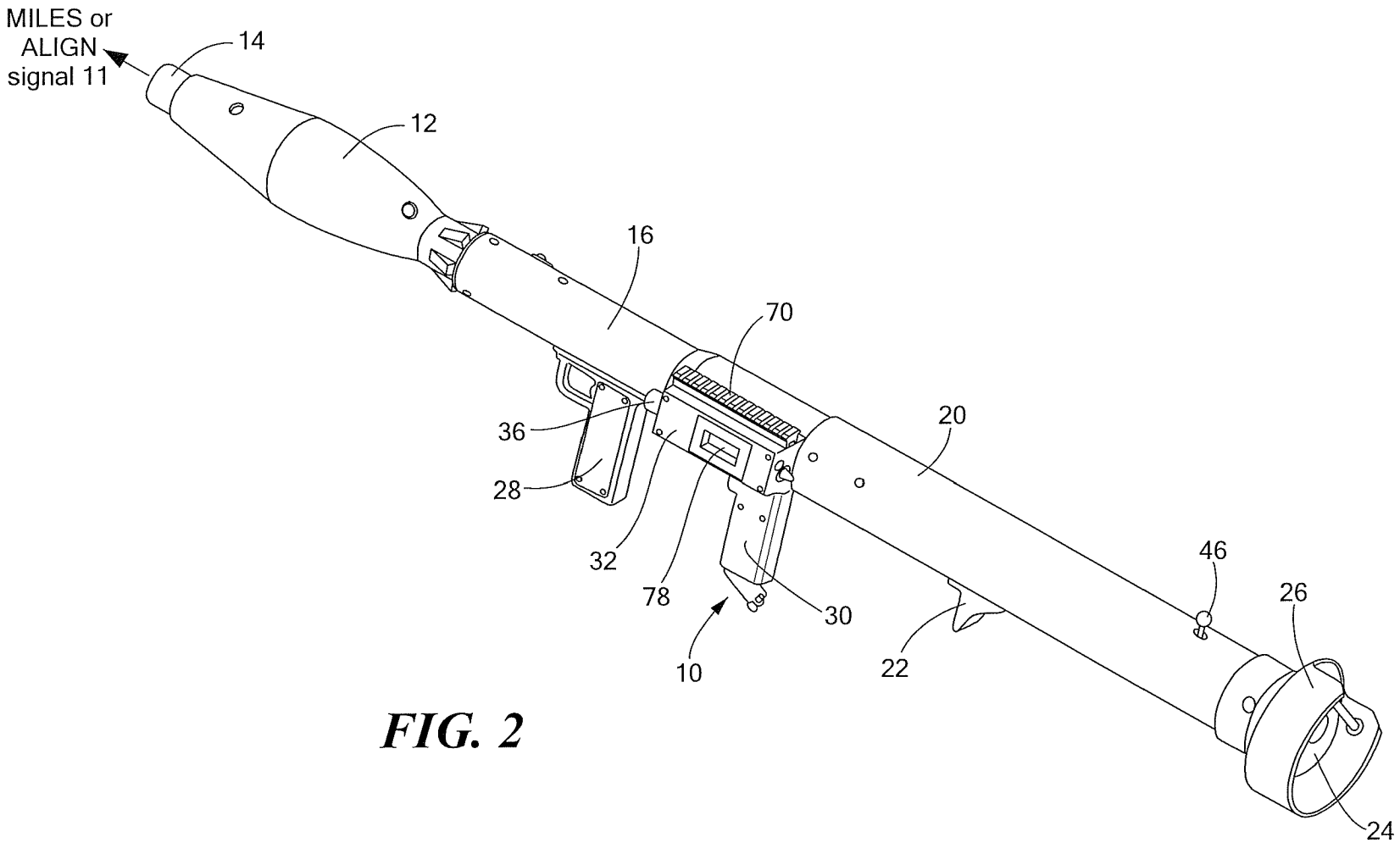
FIG. 2 is a perspective view of a rocket propelled grenade (RPG) simulation device, without the sighting attachment, as viewed from the left side, in accordance with one embodiment of the invention.
Figure 3A:
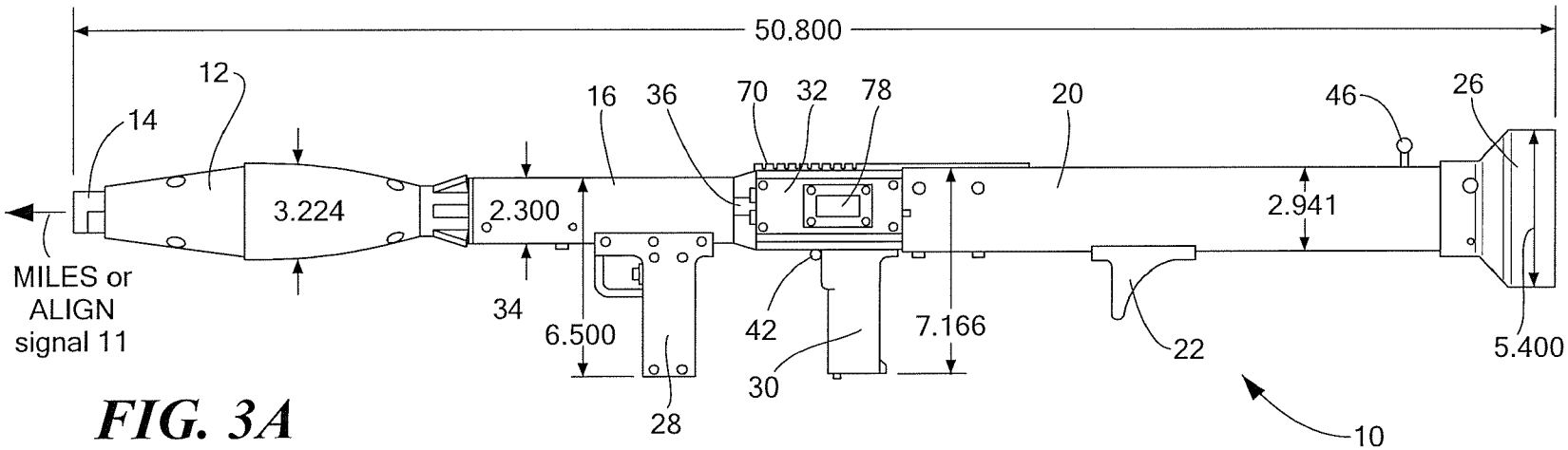
FIG. 3A is a left side view of the RPG simulation device of FIG. 2.
Figure 3B:
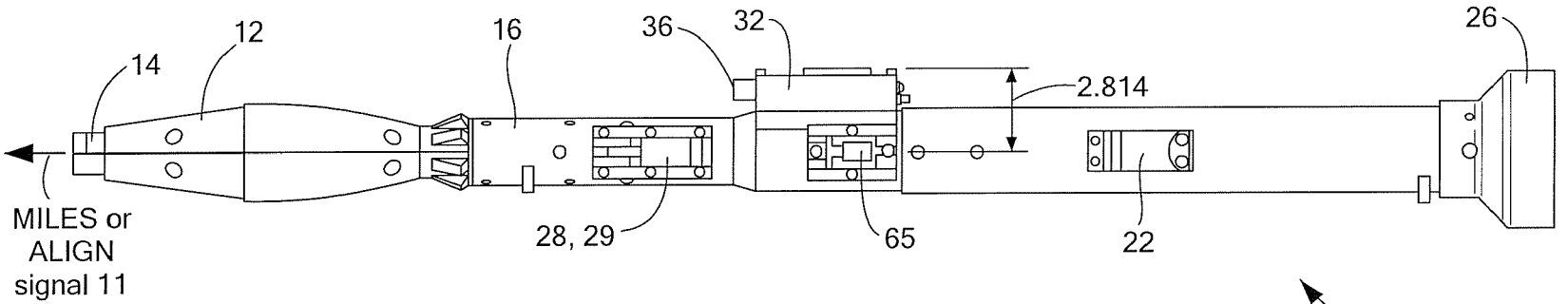
FIG. 3B is a bottom side view of the RPG simulation device of FIG. 2.
Figure 4:
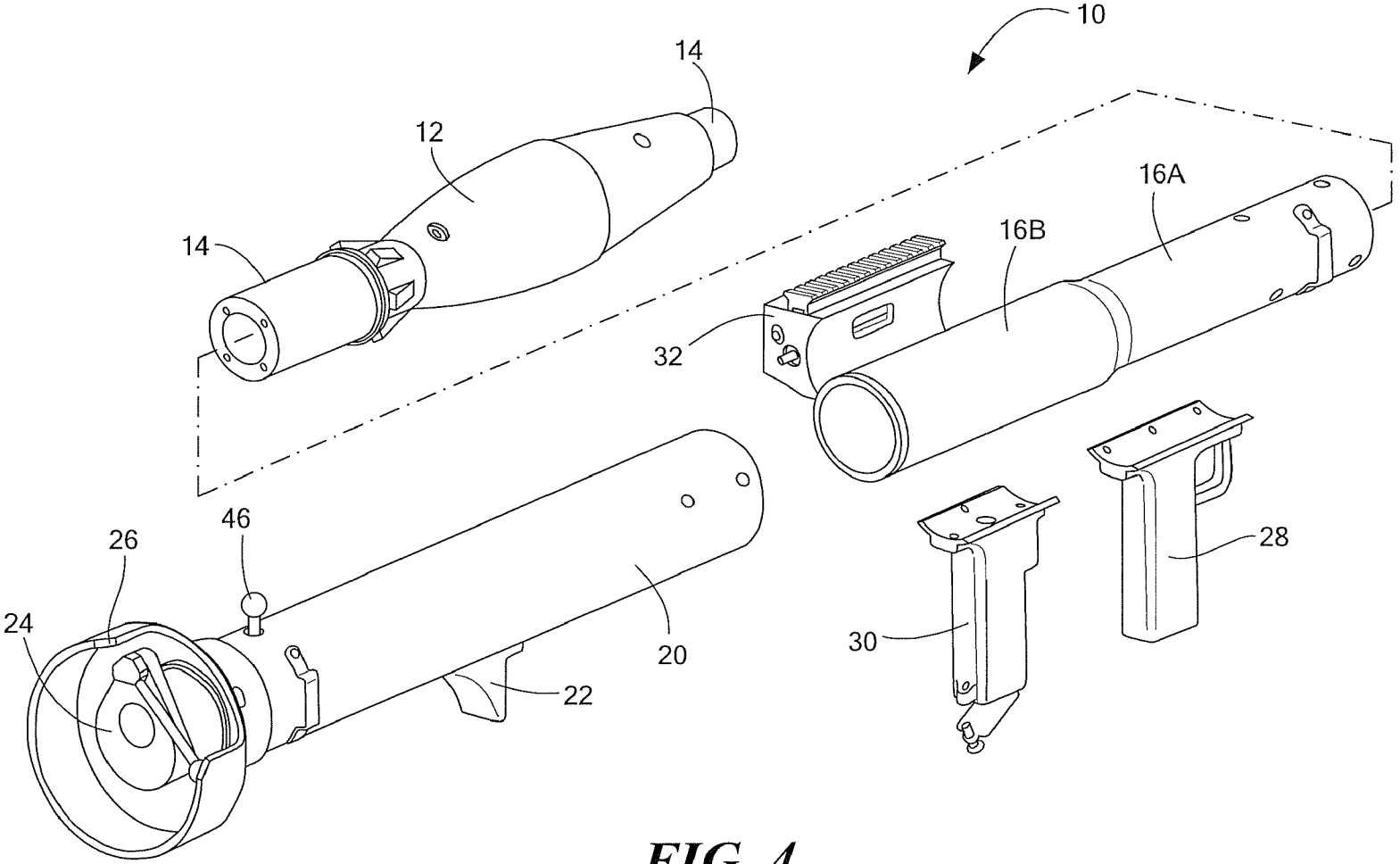
FIG. 4 is a first exploded perspective view of the RPG simulation device of FIG. 2, as viewed from the right side.
Figure 5:
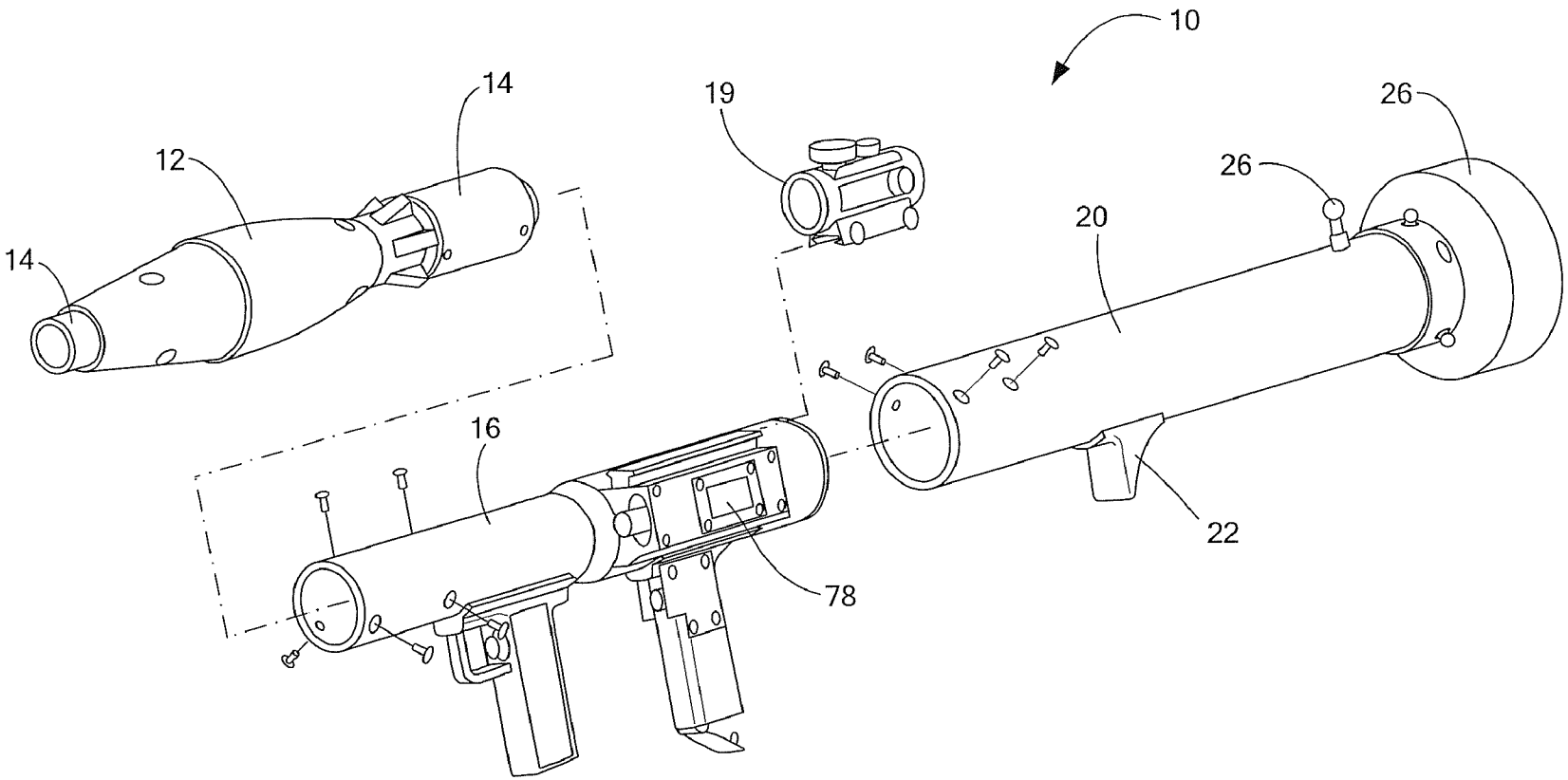
FIG. 5 is a second exploded perspective view of the RPG simulation device of FIG. 2, as viewed from the left side and also including the sighting attachment.

FIG. 2 is a perspective view of a rocket propelled grenade (RPG) simulation device 10 as viewed from the left side, in accordance with one embodiment of the invention. FIGS. 3A-5 provide additional views of the RPG simulation device 10, including a left side view (FIG. 3A), a bottom side view (FIG. 3B), a first, exploded, right perspective view (FIG. 4), and a second, exploded, left perspective view (FIG. 5), the latter of which also shows an optional field viewing scope 19. In one embodiment, the field viewing scope 19 is a Model Red Dot 30, from BSA Optics, Inc. of Ft. Lauderdale, Fla. Because the Picatinny mounting rail 70 (described further herein) is used as the mounting bracket for the field viewing scope 19, a variety of different scopes may be mounted, if desired.

Figure 1:
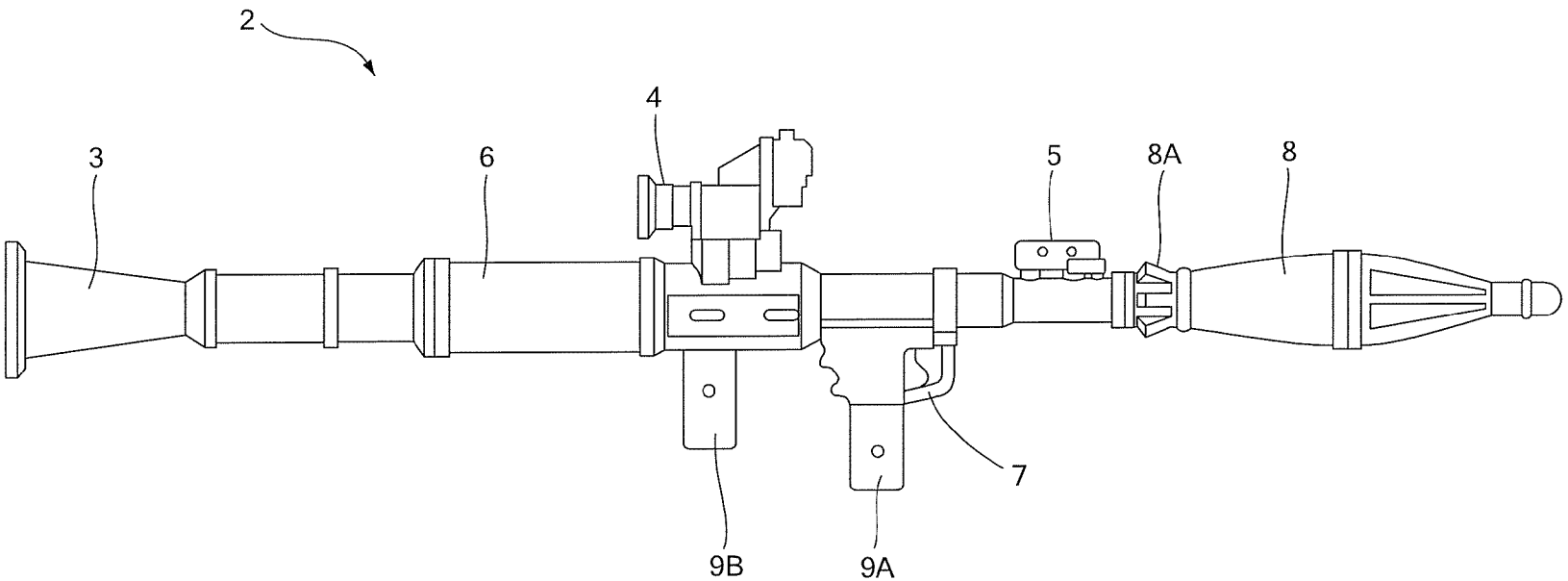
FIG. 1 PRIOR ART
FIG. 1 is a prior art image of a rocket-propelled grenade (RPG) launcher and its grenade, as viewed from the right side.

Referring now to FIGS. 2-5, the RPG simulation device 10 has aesthetics (e.g., the look and feel) designed to closely simulate an actual RPG, such as the RPG 2 of FIG. 1. The RPG simulation device 10 also includes MILES technology that enables it to produce a MILES signal 11 usable in a MILES environment to enable, for example, instrumented training events for After Action Review (AAR) training at both military home stations and at combat training centers. The RPG simulation device 10, in one embodiment, weighs approximately fifteen (15) pounds and has a length of about fifty-one (51) inches. The RPG simulation device 10 is constructed to be water-resistant and has an effective range of 300 to 1000 meters. The RPG simulation device 10 is capable of firing signals that include one or more of selectable MILES codes, a word count, and a player identification number or code. In addition, the RPG simulation device 10 provides a programmable rounds count.

Referring still to FIGS. 2-5, the RPG simulation device 10 includes a simulated grenade 12, a circuit card assembly (CCA) housing assembly 14 (which is not visible in FIG. 2, but is shown in FIGS. 4-9A, 15, and 16), and a trigger switch 34. The CCA housing assembly 14 itself contains the circuit card assembly (CCA) 80, which is described and illustrated further herein in connection with FIGS. 15 and 16. In addition, the CCA housing assembly 14 includes a dual-function laser tube 120 (not visible in FIG. 2) that can generate one or more MILES or ALIGN signals 11, as shown in FIG. 2, the dual-function laser tube is illustrated and discussed further herein in connection with FIGS. 15-17F. The embodiment of the RPG simulation device 10 as shown in FIGS. 2-5 also includes a housing implemented via the CCA housing assembly 14, a rear tube assembly 20, a front tube assembly 16, a front grip assembly 28, rear grip assembly 30, an LCD assembly 32, field viewing scope 19 and sighting attachment mounting rail 70, safety switch 53, an anti-tank weapons effect system simulator (ATWESS) assembly 24, a blast shield 26, and a shoulder stop bracket 22. Each of these elements is described further herein.

As those of skill in the art will appreciate, a housing for the RPG simulation device 10 can be implemented in many different ways. For example, it could be made using a single tube, rather than front and back tubes, with multiple tubes, in fewer or more pieces than illustrated, etc.

Figure 6A:
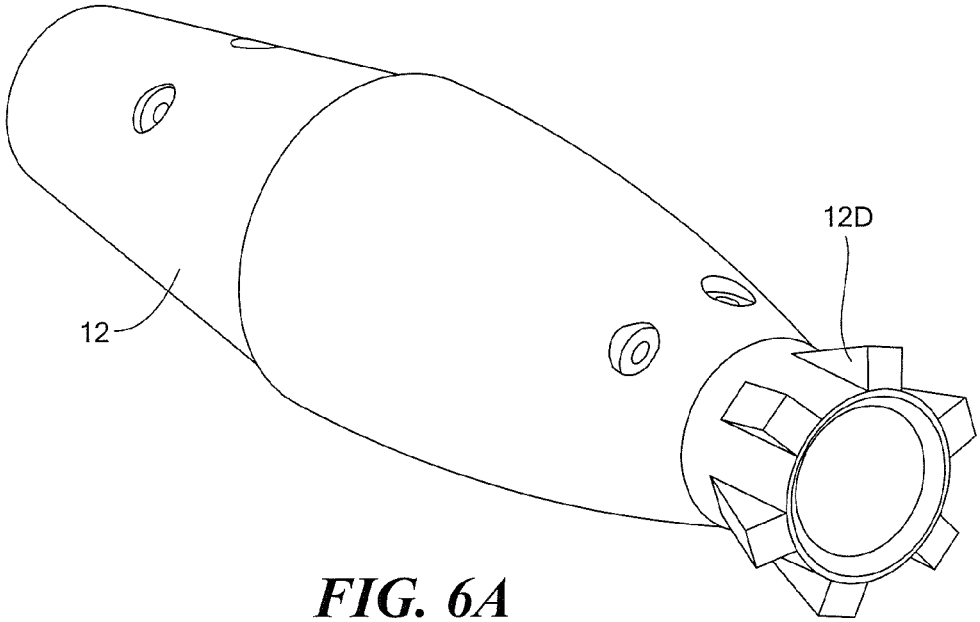
FIG. 6A is an enlarged perspective view of the grenade portion of the RPG simulation device of FIG. 2.
Figure 6B:
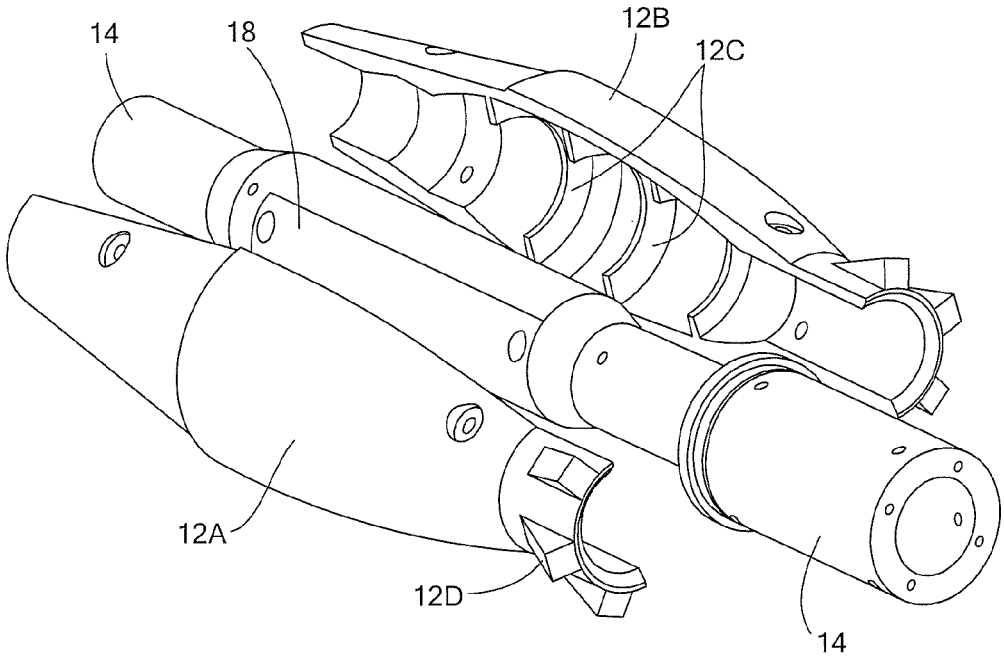
FIG. 6B is an enlarged exploded view of the grenade portion of the RPG simulation device of FIG. 2.

FIG. 6A is an enlarged perspective view of the simulated grenade 12 of the RPG simulation device 10 of FIG. 2, and FIG. 6B is an enlarged exploded view of the simulated grenade 12, showing where the CCA 80 is disposed (the CCA 80 is disposed within the tubular CCA housing assembly 14 shown in the figure). In one embodiment, the simulated grenade 12 is formed from two symmetrical pieces 12A, 12B of a substantially rigid and rugged material, such as polypropylene thermal plastic, and has a color (e.g., olive drab) to mimic the color of an actual grenade. As those of skill in the art will appreciate, however, the simulated grenade 12 can be formed of virtually any material (e.g., metals, composite, plastics, etc.), in any color, which is able to be formed into a grenade-like shape (or the shape of any other warhead being simulated) and able to withstand the rigors of the application and environment where the RPG simulation device 10 is being used, such as operation in an environment with temperatures that can range from 35° C. (−31° F.) to 62° C. (144° F.)

The simulated grenade 12 includes one or more ribs 12C that help to strengthen the structure of the simulated grenade 12 and to also conform around the CCA housing assembly 14 portion of the RPG simulation device of FIG. 6B. In addition, the simulated grenade 12 includes a plurality of fins 12D to help mimic the appearance of the actual grenade.

Figure 7:
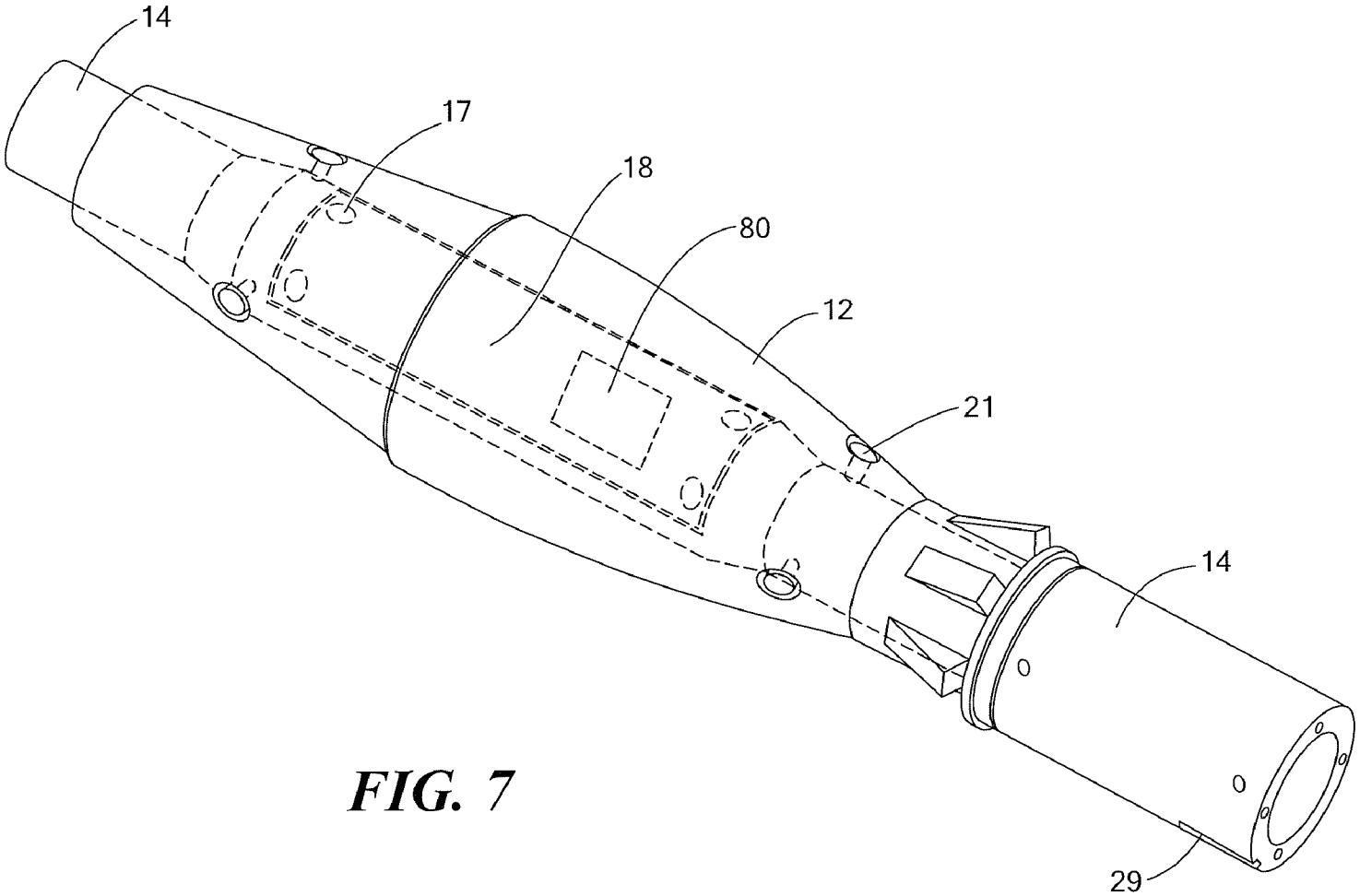
FIG. 7 is partial cross-sectional enlarged view of the grenade portion of the RPG simulation device of FIG. 2, showing the grenade mounting and circuit card assembly (CCA) housing cover.

FIG. 7 is partial cross-sectional enlarged view of the simulated grenade 12 of the RPG simulation device 10 of FIG. 2, showing the simulated grenade mounting and circuit card assembly (CCA) housing cover 18. In this embodiment, the CCA housing cover 18 is mounted to the CCA housing 14 using four hex socket head screws 17, and the simulated grenade 12 is secured to the CCA housing assembly 14 using eight Philips screws 21. The method of mounting, as well as the particular configuration and arrangement of mounting screws is merely illustrative and not intended as limiting. Using screws helps to enable the simulated grenade 12 and/or the CCA 80 (contained within the CCA housing 14) to be more easily serviceable. The CCA housing assembly 14 also includes a groove 29 that cooperates with the alignment screw 23 (see FIG. 8) to help orient the CCA housing assembly 14 within the front tube 16.

Figure 8:
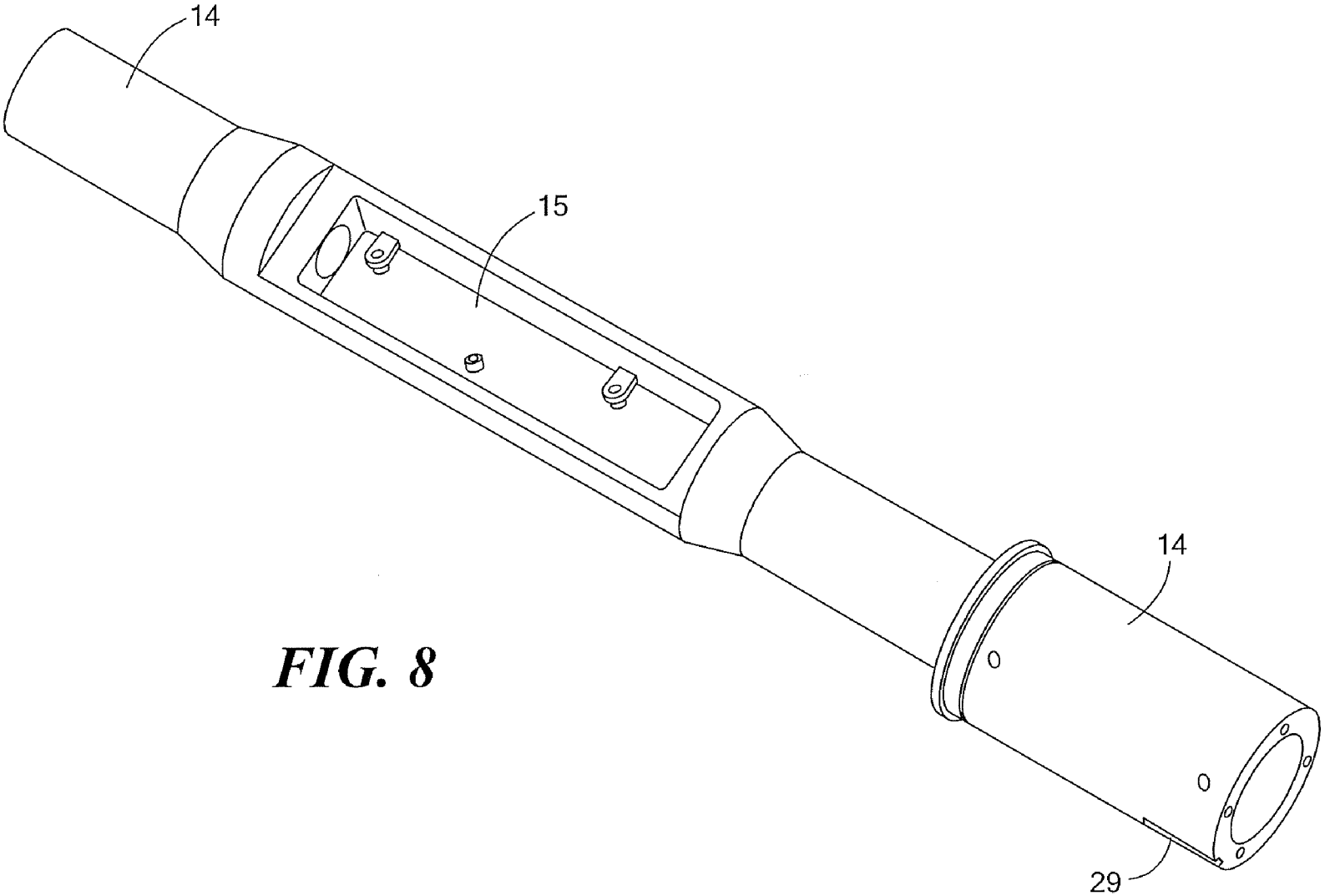
FIG. 8 is an enlarged view of the CCC housing assembly of the RPG simulation device of FIG. 2.
Figure 9A:
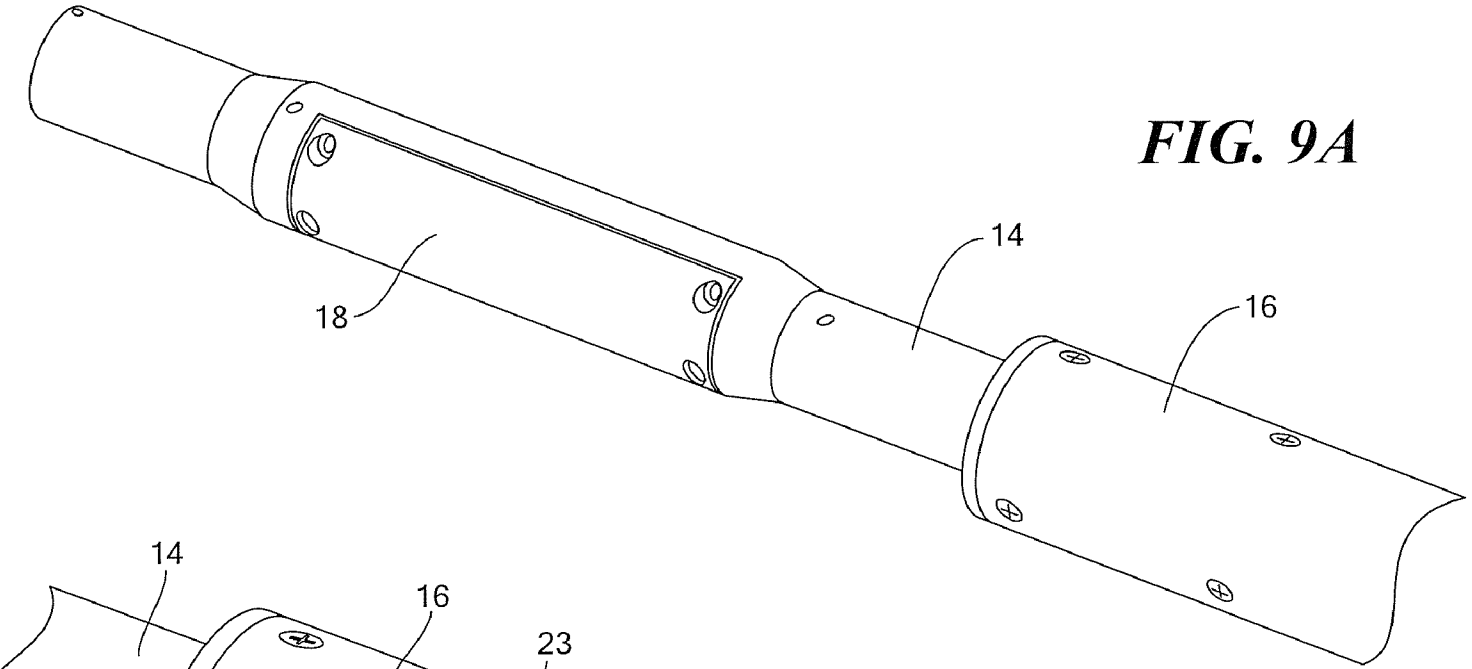
FIG. 9A is a first enlarged view showing the mounting of the CCA housing to the front tube, for the RPG simulation device of FIG. 2.
Figure 9B:
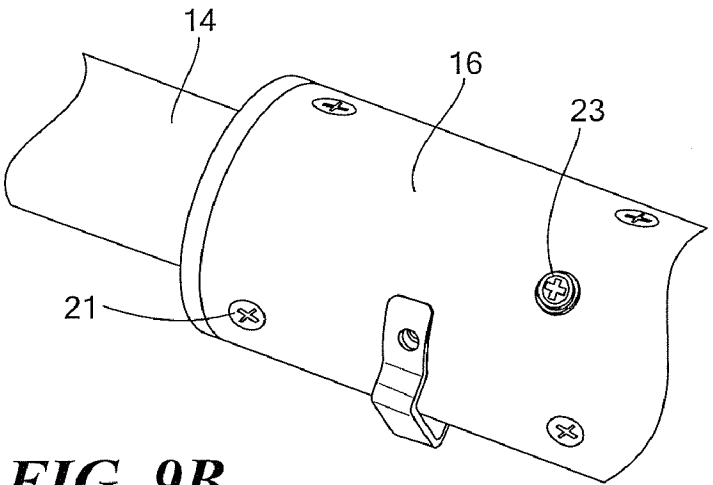
FIG. 9B is a second enlarged view showing the mounting of the CCA housing to the front tube, for the RPG simulation device of FIG. 2.

FIG. 8 is an enlarged view of the CCA housing assembly 14 of the RPG simulation device 10 of FIG. 2, FIG. 9A is a first enlarged view showing the mounting of the CCA housing to the front tube 16, for the RPG simulation device of FIG. 2, and FIG. 9B is a second enlarged view showing the mounting of the CCA housing 14 to the front tube 16, for the RPG simulation device 10 of FIG. 2. Referring to FIGS. 8-9B, the CCA housing assembly 14 is constructed of a substantially rigid material, such as aluminum 6061-T6 material, and has an appearance and color (e.g., anodized olive drab) to further mimic the appearance of an actual RPG. The CCA housing assembly 14 is shaped so as to house the CCA 80 (FIG. 15 and FIG. 16) and also a laser tube assembly 120 (FIG. 17), and includes an opening 15 in which the CCA 80 is mounted, as well as a CCA housing cover 18. The CCA housing assembly 14 is secured to the front tube 16 with six screws 21. In addition, an alignment screw 23 (which helps serve as an alignment indicator) is used for orientation, and alignment screw 23 is coupled through slot 29 (see FIGS. 7, 8) to help to ensure that the CCA housing assembly 14 is installed into the front tube 16 in the same orientation both during production and in later follow on field repairs.

Figure 10:
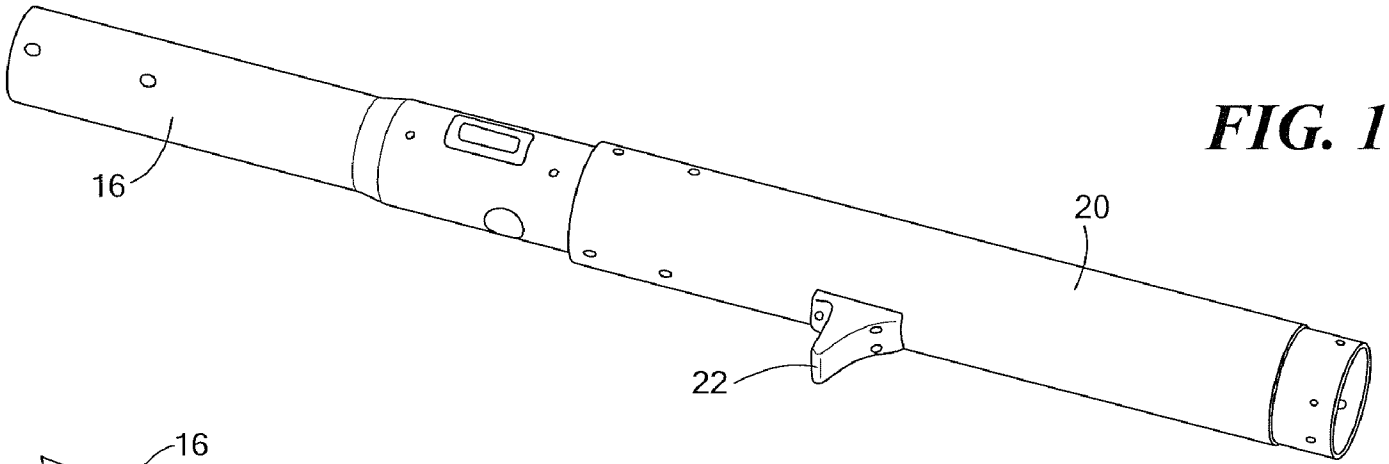
FIG. 10 is a perspective view showing the front and rear tubes of the RPG simulation device of FIG. 2.

FIG. 10 is a perspective view showing the front and rear tubes 16, 20, respectively, of the RPG simulation device 10 of FIG. 2, coupled together. The front tube 16 and rear tube 20 are each made of a substantially rigid material, such as aluminum 6061-T6. The front tube 16 is inserted into the rear tube 20 and secured by six screws. To simulate the appearance of an actual RPG, the front tube 16 is anodized black and the rear tube 20 is anodized brown. The shoulder stop bracket 22 can be provided in various ways. In one embodiment, the shoulder stop bracket 22 is molded out of a substantially rigid material, such as brown polycarbonate plastic or anodized brown metal and secured to the rear tube 20, such as by screws, welding, soldering, adhesives, or any other attachment method. In another embodiment, the shoulder stop bracket 22 can be formed integrally with the rear tube 20.

Figure 11A:
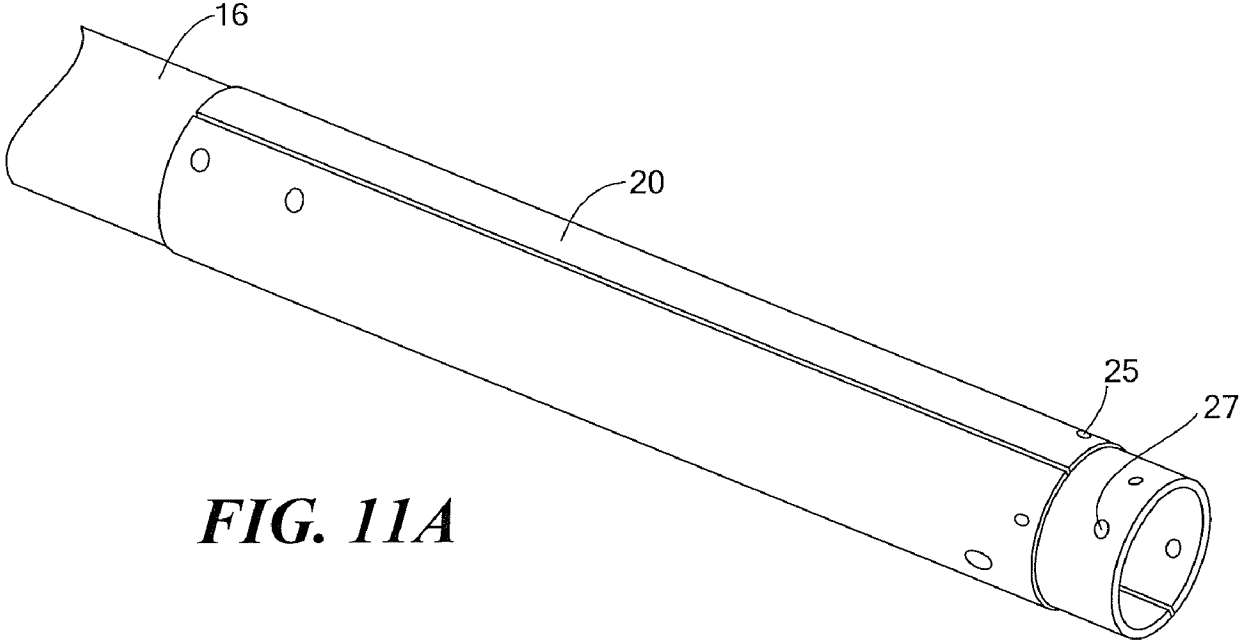
FIG. 11A is an enlarged perspective view showing the rear tube and its blast shield mounting holes, for the RPG simulation device of FIG. 2.
Figure 11B:
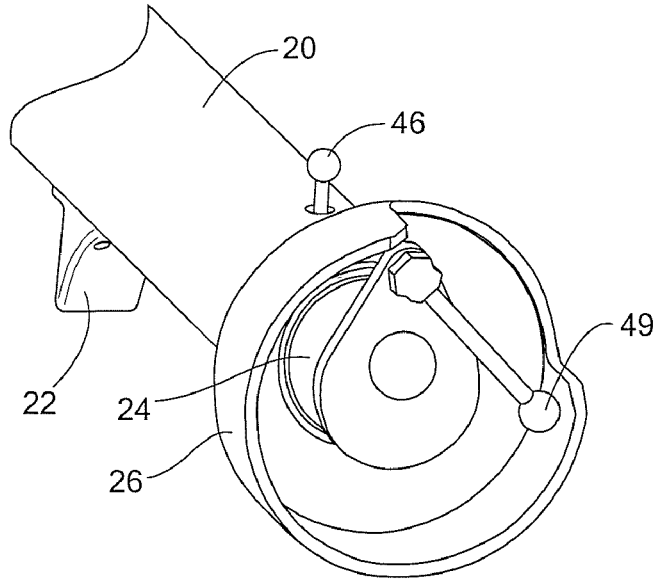
FIG. 11B is an enlarged perspective view showing the ATWESS assembly and blast shield mounted to the rear tube, for the RPG simulation device of FIG. 2.

FIG. 11A is an enlarged perspective view showing the rear tube 20 and its blast shield mounting holes 25, for the RPG simulation device 10 of FIG. 2, and FIG. 11B is an enlarged perspective view showing the ATWESS assembly 24 and blast shield 26 mounted to the rear tube 20, for the RPG simulation device of FIG. 2. The ATWESS assembly 24 uses an ATWESS cartridge (not shown) and is able to provide one or more indicators or physical effects, such as a realistic weapon signature, including muzzle flash, noise, and back-blast smoke, appropriate for the simulation of a grenade launched from an RPG. The ATWESS breech lock lever 49 locks the ATWESS cartridge into place.

ATWESS simulation devices are available from various vendors, including Cubic Defense Systems of San Diego, Calif. In one embodiment, the ATWESS assembly 24 and blast shield 26 are substantially the same as those used on the simulated VIPER device used with the MILES system.

The ATWESS assembly 24 includes an ATWESS breech lock lever 49 (to lock the ATWESS cartridge cover) and an ATWESS safety lever 46 that must be pulled to arm the ATWESS. The blast shield 26 is provided to protect the operator and to collimate the blast from the ATWESS assembly 24 to reduce the likelihood injury to nearby personnel.

Figure 12A:
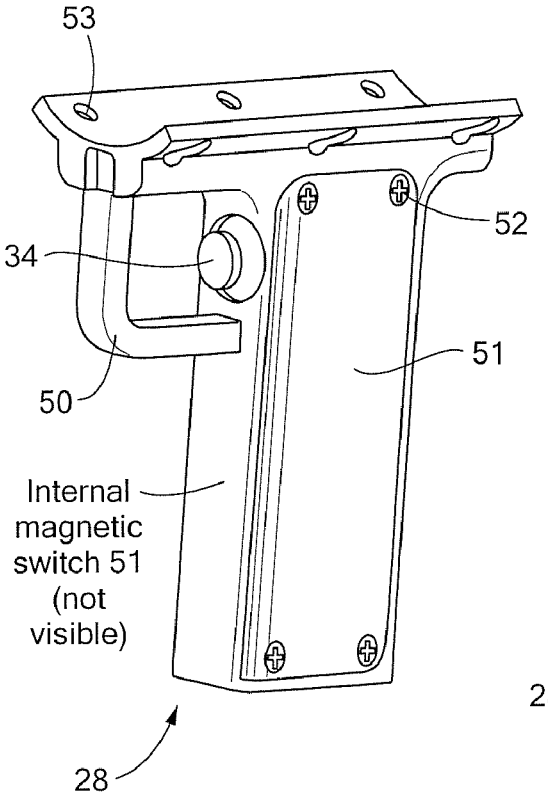
FIG. 12A is an enlarged perspective view showing the front grip assembly, including finger guard, for the RGP simulation device of FIG. 2.
Figure 12B:
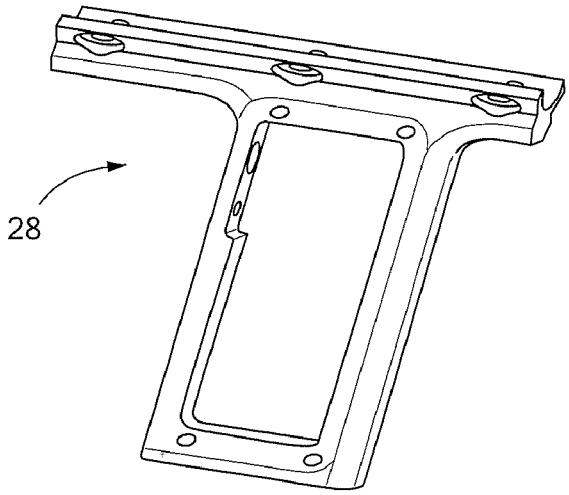
FIG. 12B is an enlarged side view of the front grip assembly of FIG. 11A, without the finger guard.

FIG. 12A is an enlarged perspective view showing the front grip assembly 28 for the RPG simulation device 10 of FIG. 2, with the finger guard 50, and FIG. 12B is an enlarged side view of the front grip assembly 28 of FIG. 11A, without the finger guard 50. The front grip assembly 28 includes several user accessible controls, including a trigger switch 34, as well as an internal magnetic switch 47 (not visible in the figures). The magnetic switch 47 communicates with the CCA 80 to activate a Helium Neon Laser Tube located within a so-called dual function laser tube 120 (FIG. 15) that also is in communication with the CCA 80 for alignment purposes. Placing a magnet near the bottom of the front grip assembly 28 can trigger the magnetic switch 47. The front grip assembly 28 can include a removable finger guard 50 and a cover 51. To help simulate the appearance of an actual RPG, the front grip assembly 28 is anodized black and the cover 51 is anodized brown and mounted to the rest of the front grip assembly 28 via four counter-sunk screws. The front grip assembly 28 couples to the front tube 16 via screws mounted through a plurality of screw holes 53.

Figure 13:
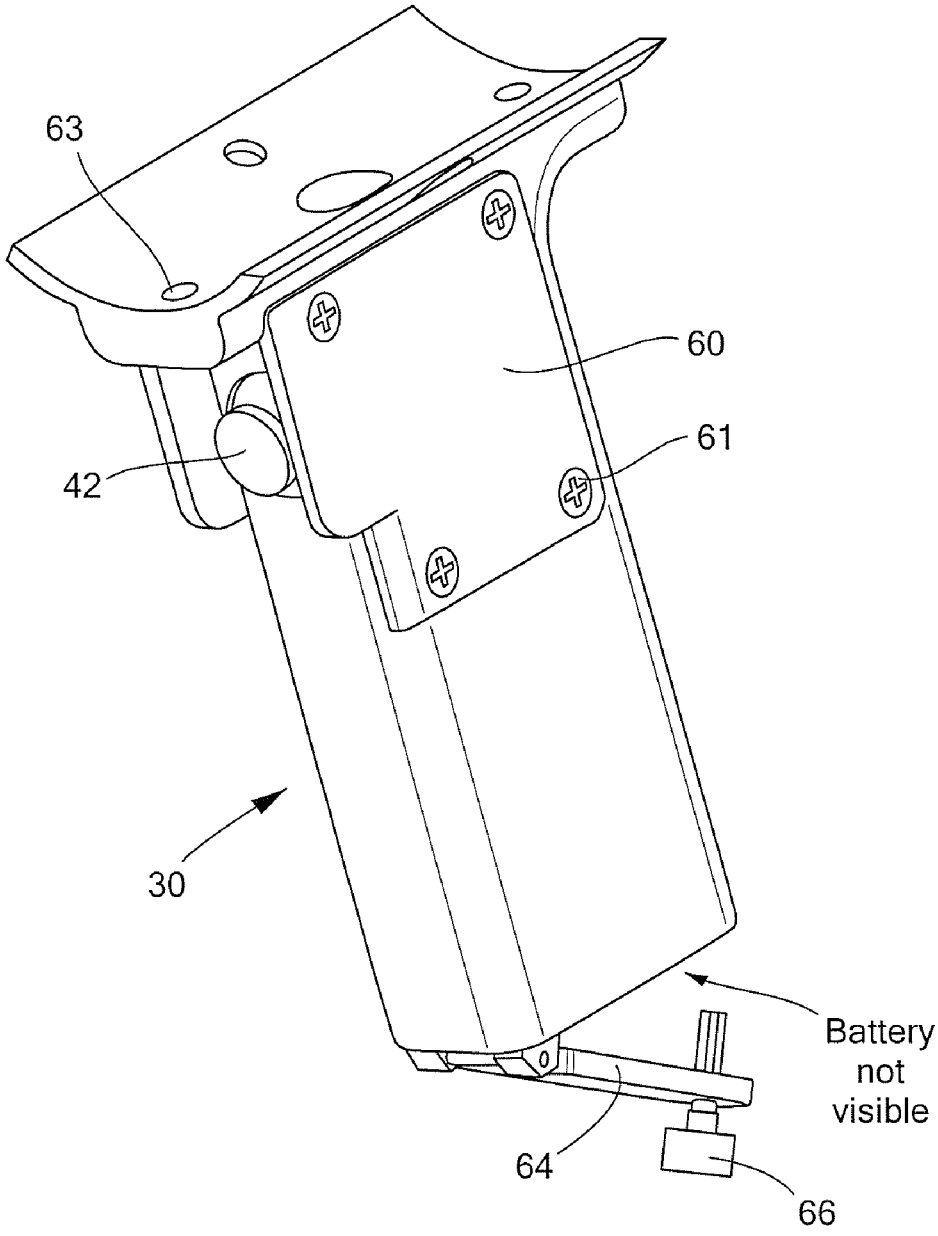
FIG. 13 is an enlarged perspective view of the rear grip assembly of the RPG simulation device of FIG. 2.

FIG. 13 is an enlarged perspective view of the rear grip assembly 30 of the RPG simulation device of FIG. 2. The rear grip assembly 30 houses a battery 65 (e.g., a 9 volt battery) (not visible in this Figure) that is held in place via battery door 64 and battery door knob 66, which advantageously has a low profile. The rear grip assembly 30 includes a user accessible control, such as the safety switch 42. During operation, in one embodiment, the safety switch 42 must be engaged prior to engaging the trigger switch 34. The rear grip assembly 30, like the front grip assembly 28, is anodized black, with a brown cover 60, to simulate the appearance of an actual RPG. The cover 60 is mounted to the rear grip assembly 30 using four counter-sunk screws, and the rear grip assembly couples to the front tube 16 via screws mounted through a plurality of screw holes 63.

Although the functions of the front grip assembly 28 and rear grip assembly 30 could be implemented in a single grip, it is advantageous if they are provided as part two separate grips to ensure that an operator has both hands on the RPG simulation device 10 when using it, to improve safe use of the RPG simulation device 10.

Figure 14A:
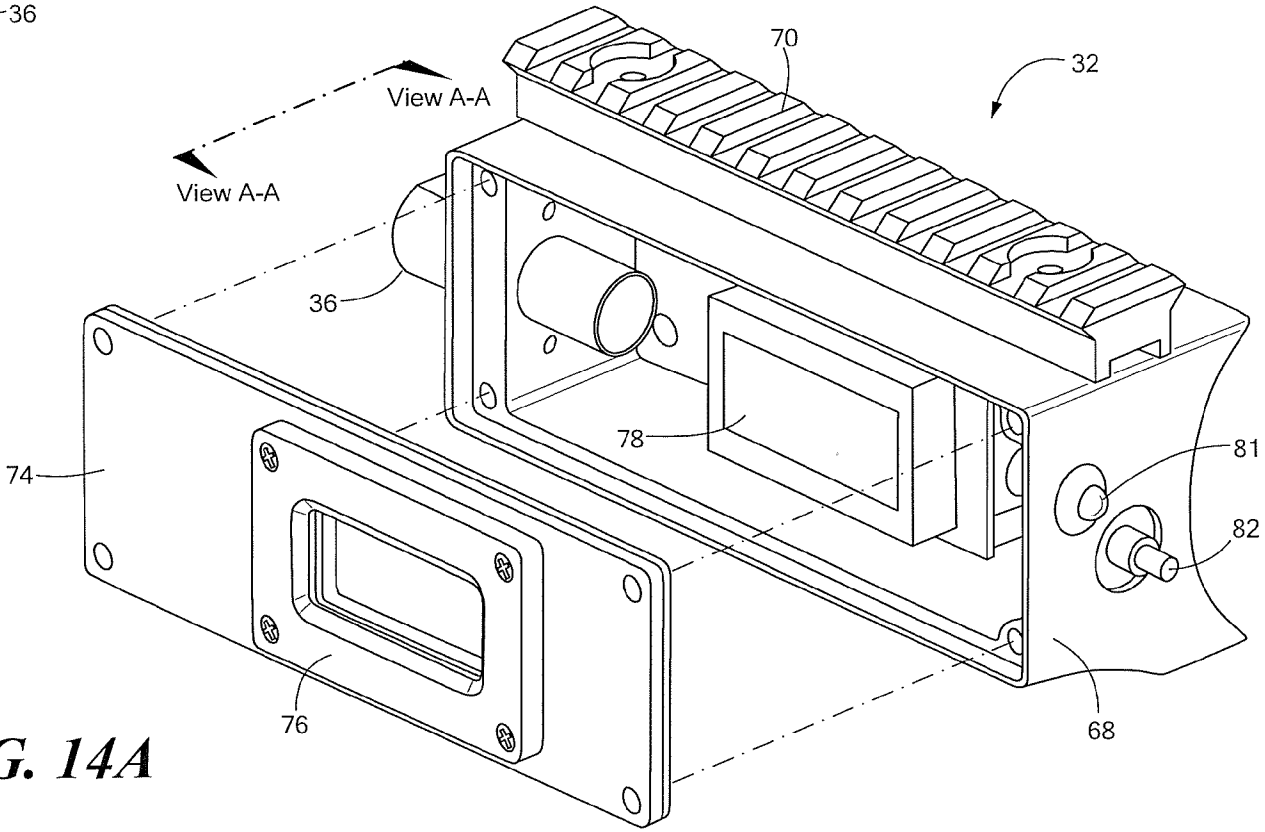
FIG. 14A is an enlarged exploded perspective view of the liquid crystal display (LCD) housing assembly for the RPG simulation device of FIG. 2.

FIG. 14A is an enlarged exploded perspective view of the liquid crystal display (LCD) housing assembly 32 for the RPG simulation device of FIG. 2. The LCD housing assembly 32 includes a liquid crystal display (LCD) 78, an indicator LED 81 (which illuminates when the RPG simulation device 10 is fired), a reset push button switch 82 (used to reset the RPG simulation device 10, reset round count, etc.), an LCD housing assembly cover 74, and LCD cover 76, and a controller key receptacle switch 36 (also referred to herein as a weapon switch), which is usable with a controller key switch, explained further herein.

In at least some embodiments, the LCD housing assembly 32 includes a so-called Picatinny mounting rail 70 (i.e., a bracket used on some firearms to provide a standardized mounting for accessories such as the field viewing scope 19; such a bracket can be provided in accordance with MIL-STD-1913, first published by the U.S. Picatinny Arsenal). Picatinny rails are available from numerous suppliers, including Centurion Tactical Systems of Layton Utah.

Figure 14B:
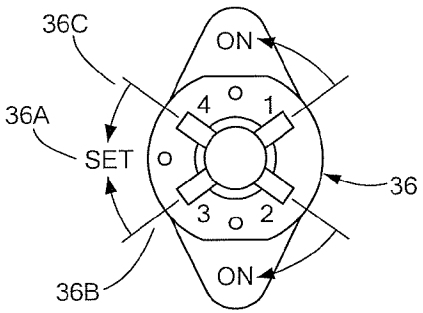
FIG. 14B is an enlarged cross-sectional view of the controller key receptacle switch for the RPG simulation device of FIG. 2.

FIG. 14B is a cross sectional view of the controller key receptacle switch 36. As FIG. 14B illustrates, the controller key receptacle switch 36 has four positions and is used to set the RPG simulation device 10 in one of several operating modes. In at least one embodiment, a controlling operator has a first key (i.e., a so-called "green" master key) capable of putting the RPG simulation device 10 into either a so-called "Dry Fire" mode (a mode with no ATWESS, e.g., no smoke) or an ATWESS mode (a mode in which an ATWESS cartridge is used as part of the simulation), and the RPG simulation device operator has a second key (i.e., a so-called "yellow" weapon key).

The following modes of operation are provided by way of example and are not limiting.

To put the RPG simulation device 10 in "Dry Fire" mode, assuming a battery 65 is installed into the rear grip 30, the green master key is then inserted into the controller key receptacle switch 36 and turned to the "set" position 36A, and then the green master key is then turned to position 3 (36B in FIG. 14B). The green master key is then removed from controller key receptacle switch 36, and the RPG simulation device 10 will be in "Dry Fire mode". The operator of the RPG simulation device 10 can then press the push to read switch 82 to see an indication of the "Rounds Remaining" on the LCD display 78 (e.g., four rounds remaining). To fire the RPG simulation device 10, an operator inserts his yellow operator key into the controller key receptacle switch 36, presses the safety switch 42 (FIG. 13), then the trigger switch 34 (FIG. 12), and the LED 81 illuminates when the laser signal 11 is emitted, when the laser transmitter 206 (FIG. 16) is fired by the trigger switch 34. The laser transmitter 206 sends a laser signal, such as a pulse of laser energy and/or eye-safe, invisible laser (light) beams, toward the target. If the laser beam hits the target, detector assemblies on the target sense the beam and cause an alarm to sound. In addition, if the target is a vehicle, an externally-mounted light on the vehicle will flash.

Optionally, the operator of the RPG simulator device 10 may wear a harness or vest equipped with a laser detector assembly and alarm and which also includes a similar controller key receptacle switch 36. The laser detector can, for example, be a detector usable with a MILES-type of system. If a MILES-equipped weapon fires a laser signal at the operator of the RPG simulator device 10, one of two results may occur: if it is a "near miss" the alarm on the harness sounds for one second; if it is a "hit", the alarm sounds continuously and the operator has been "killed". The operator's yellow weapon key can be removed from the RPG simulator device 10 and inserted into the controller key receptacle switch 36 (on the harness) to shut off the alarm. In one embodiment, only the green master key can perform a system reset on the RPG simulator device 10 (which provides for a new set of rounds).

To put the RPG simulation device 10 in "ATWESS" mode, assuming a battery 65 is installed in the rear grip 30, the green master key is then inserted into the controller key receptacle switch 36 and turned to the "set" position 36A, and then the green master key is then turned to position 4 (36C in FIG. 14B). The green master key is then removed from controller key receptacle switch 36, and the RPG simulation device 10 will be in "ATWESS Mode." The operator of the RPG simulation device 10 can then press the push to read switch 82 to see an indication of the "Rounds Remaining" on the LCD display 78 (e.g., four rounds remaining).

Operation of the RPG simulator device 10 in ATWESS mode is similar to operation in DRY FIRE mode, except that in ATWESS mode, an operator cannot fire the laser transmitter unless an ATWESS cartridge is loaded and the ATWESS safety lever 46 is in the ARMED position. The operator ensures that the backblast area near the blast shield 26 is clear, and centers the target (e.g. via field viewing scope 19). The target is tracked, and the operator then fires at the target, pressing and holding the safety switch 42 first and then the pressing the trigger switch 34. In one embodiment, the operator can fire a round every 10 seconds, for up to four rounds, with each round using its own ATWESS cartridge. After the firing, an operator can check the "Rounds Remaining" by depressing the push to read switch 82, and a displayed rounds counter will show rounds remaining. When the round is fired, the ATWESS provides an audible sound equivalent to the sound a real round would make, as well as a blast of smoke similar to that produced during the firing of a "real" rocket propelled grenade.

Figure 15:
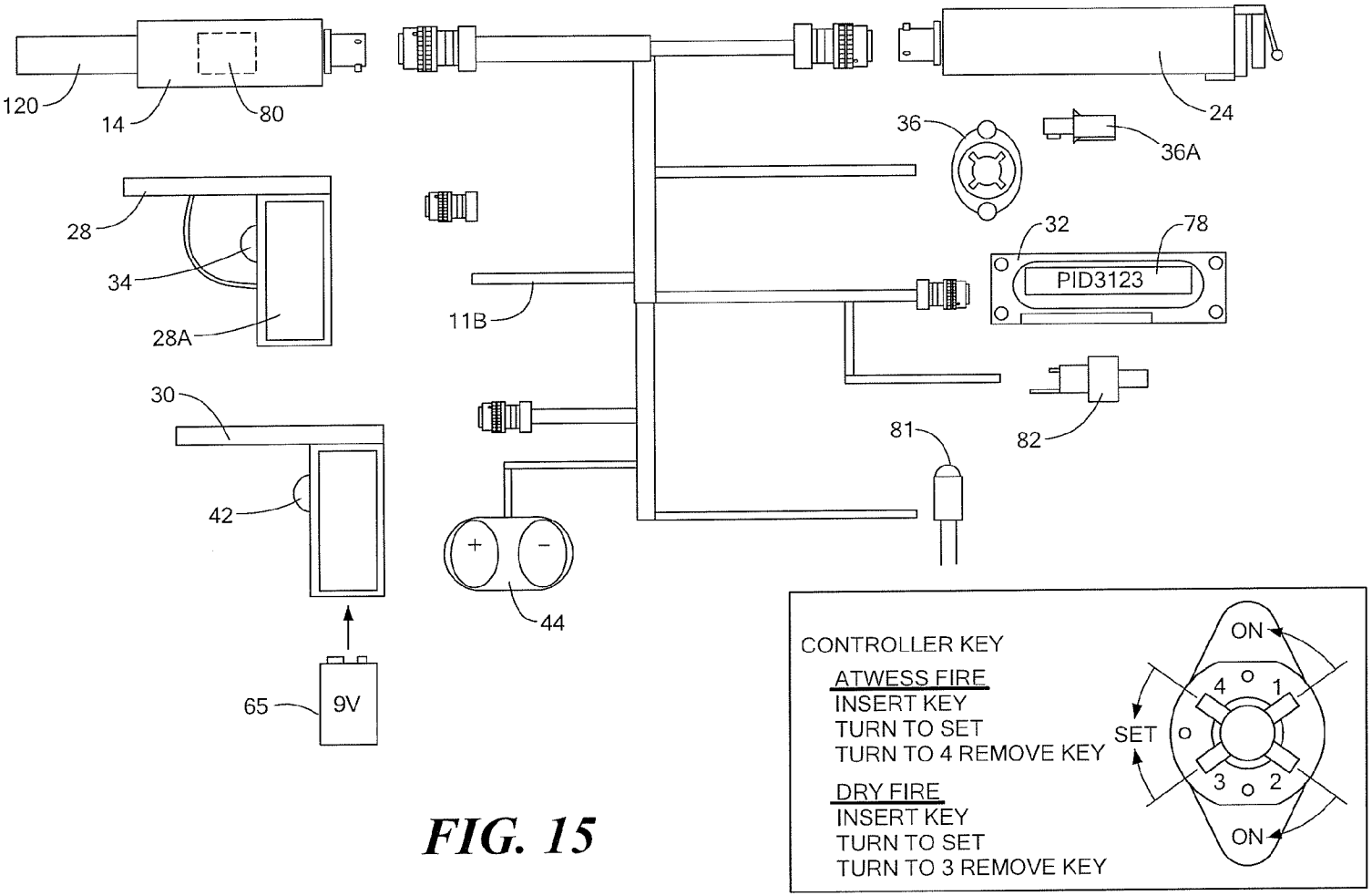
FIG. 15 is a wiring harness interconnection diagram for the RPG simulation device of FIG. 2.

FIG. 15 is a wiring harness interconnection diagram for the RPG simulation device 10, of FIG. 2, showing internal interconnections amongst some of the elements shown in FIGS. 2-14. All of the components shown in FIG. 15 are interconnected to at least the CCA 80 of FIG. 16, which is disposed within the CCA housing 14 of FIG. 15, but is not itself visible in FIG. 15. In at least one embodiment, the CCA 80 acts as a controller for one or more functions of the RPG simulation device 10. The CCA 80 couples to a laser tube 120 (which contains one or more lasers, such as a 904 nm Infrared wavelength laser tube, to generate, direct, and control the MILES laser signals that are emitted by the RPG simulation device 10 and to also control the laser alignment signal 11B (which helps serve as an alignment indicator) used to align the MILES laser signals 11 (FIG. 2) emitted by the RPG simulation device 10. The laser alignment signal 11B is activated via a magnetic switch (not visible in FIG. 15) that is switched when a magnet is placed in proximity to the bottom 28A of the front grip assembly 28.

The CCA 80 is further interconnected with (and responsive to) the trigger switch 34 on the front grip assembly 28, as well as to a safety switch 42 on the rear grip assembly 30. The trigger switch 34 and safety switch 42 can be used independently of each other or in conjunction with each other, depending on the mode of operation of the RPG simulation device 10, as described above. In one embodiment, the RPG simulation device 10 will only fire (in either mode) if the safety switch 42 is pressed and held first and then the trigger switch 34 is pressed. The mode of operation of the RPG simulation device 10 is set via the weapon switch 36, which, in one embodiment, can be controlled or set via a removable weapon switch key 36A (e.g., the controller green key described previously). The CCA 80 communicates with and controls the ATWESS assembly 24, in response to inputs at the trigger switch 34 and safety switch 42.

The CCA 80 monitors the terminals 44 of battery 65, to monitor the battery voltage and provide a "low battery" indicator on LCD display 78 of the LCD assembly 32. The CCA 80 is responsive to the push to read switch 82 and provides a signal to the LED indicator 81.

Figure 16:
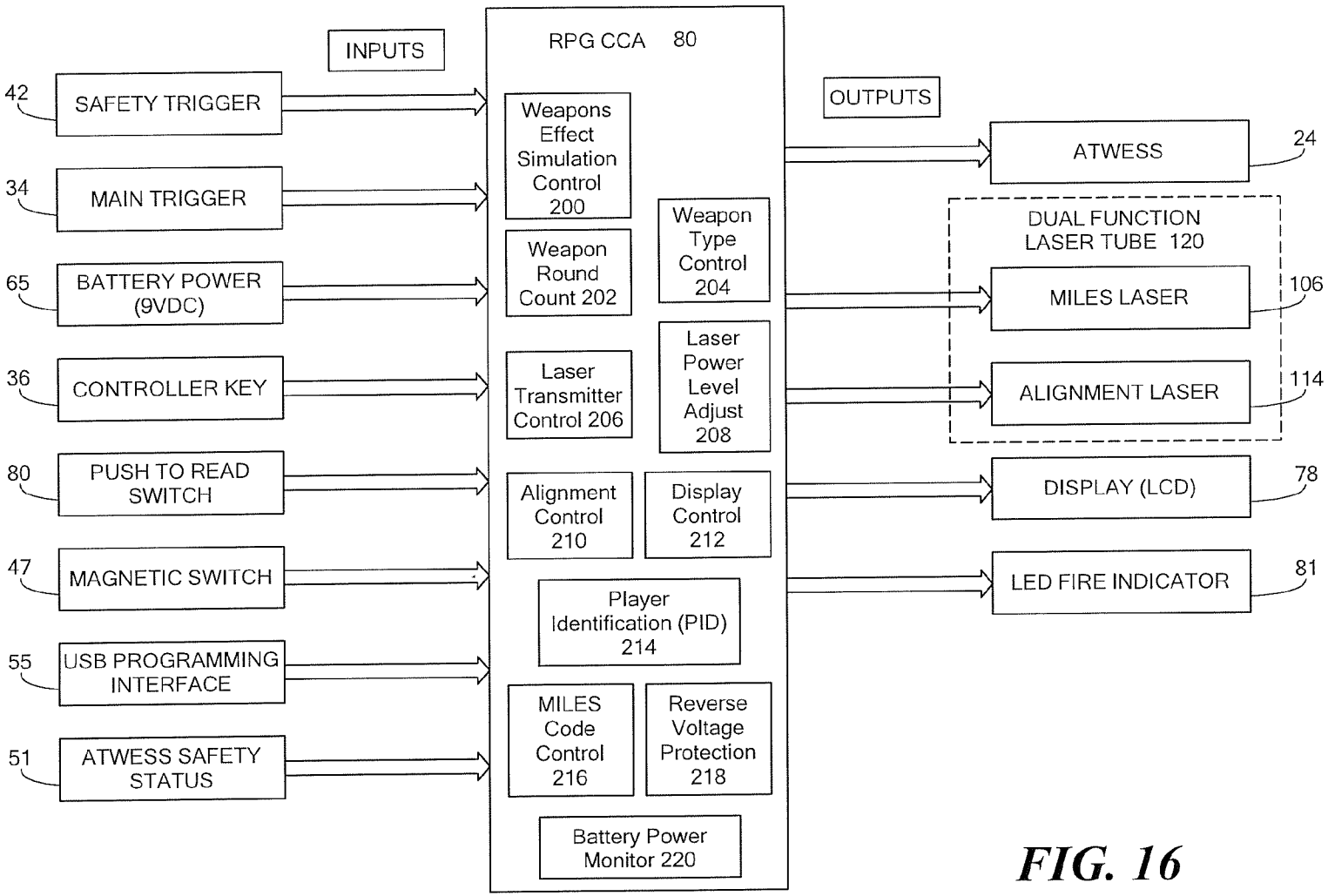
FIG. 16 is a functional block diagram of the CCA inputs and outputs, used with the RPG simulation device of FIG. 2.

FIG. 16 is functional block diagram of the CCA 80 and its inputs and outputs, as used with the RPG simulation device 10 of FIG. 2. In one embodiment, the CCA 80 is sized to fit in the opening 15 on the CCA housing assembly 14 and is about 3.5 inches by 1 inch in size. The inputs to the CCA 80 include the settings of/signals from the safety switch 42 and main trigger switch 34, signals monitoring the power/voltage level of the battery 65, the setting of the controller key receptacle switch 36, the setting of the push to read switch 82, the setting of the magnetic switch 47, the setting of the ATWESS safety arming switch 46, and inputs from a USB programming interface 55 (USB port).

The outputs of the CCA 80 include a signal controlling the ATWESS 24, signals to the display 80 and the LED fire indicator 81, data to the USB port 55, and the signals directed to the dual function laser tube 120 to energize a laser diode (not visible in the Figure) in the dual function laser tube 120, so as to cause the RPG simulation device 10 to emit a laser beam (either the MILES laser 106 or an alignment laser 114) towards a given target.

The CCA 80 itself includes functionality providing weapons effect simulation control 200 (to control the ATWESS 24), weapon round count 202 (where the round count can relate to a specific weapon type via the weapon type control 204), signals to control the laser diode 206, signals to control the laser power level adjustment 208 (including hit and near miss laser power level adjustment), signals to control alignment 210, signals to control the display 212 (including display of PID, rounds remaining, weapon type, and battery low indicators), capability to track up to 5280 player identification codes (PID) (e.g., Enhanced MILES PID), encoding all existing MILES codes 216, providing reverse voltage protection 216, monitoring battery power 220, and tracking player identification (PID) (e.g., via a 5280 Enhanced PID).

FIGS. 17A and 17B are front and side views, respectively, of the dual function laser tube 120 used with the RPG simulation device of FIG. 2. FIGS. 17C and 17D are front and side views, respectively of a first laser tube 100 used with the dual function laser tube of FIGS. 17A and 17B. FIGS. 17E and 17F are front and side views, respectively, of the second laser tube 110 used with the dual function laser tube of FIGS. 17A and 17B. As FIG. 17 illustrates, both the MILES laser tube 110 and the alignment laser tube 110 are disposed within the dual function laser tube 120.

The first laser tube 100 is the MILES laser tube and includes laser transmitter/laser diode that emits a laser beam when energized (such as when an operator presses the trigger switch 34 to cause the CCA 80 to generate a signal to energize the laser transmitter). In one embodiment, the laser transmitter uses a so-called MOCVD (metal organic chemical vapor deposition) type of laser, which is an infra-red, non-visible laser, available from Laser Diode, Inc., of Edison, N.J.

The second laser tube 110 includes a laser transmitter (not visible in FIG. 18) capable of generating a read laser "pointer" type beam for alignment purposes.

In describing the embodiments of the invention illustrated in the figures, specific terminology (e.g., language, phrases, product brands names, etc.) is used for the sake of clarity. These names are provided by way of example only and are not limiting. The invention is not limited to the specific terminology so selected, and each specific term at least includes all grammatical, literal, scientific, technical, and functional equivalents, as well as anything else that operates in a similar manner to accomplish a similar purpose. For example, although particular materials (e.g., aluminum, polycarbonate, etc.) are described as being used in various embodiments to construct aspects of the RPG simulation device, those of skill in the art will recognize that numerous other materials could work equally well. Furthermore, in the illustrations, Figures, and text, specific names may be given to specific features, processes, military programs, etc. Such terminology used herein, however, is for the purpose of description and not limitation.

Although the invention has been described and pictured in a preferred form with a certain degree of particularity, it is understood that the present disclosure of the preferred form, has been made only by way of example, and that numerous changes in the details of construction and combination and arrangement of parts may be made without departing from the spirit and scope of the invention.

In the Figures of this application, in some instances, a plurality of system elements may be shown as illustrative of a particular system element, and a single system element or may be shown as illustrative of a plurality of a particular system elements. It should be understood that showing a plurality of a particular element is not intended to imply that a system or method implemented in accordance with the invention must comprise more than one of that element, nor is it intended by illustrating a single element that the invention is limited to embodiments having only a single one of that respective elements. In addition, the total number of elements shown for a particular system element is not intended to be limiting; those skilled in the art can recognize that the number of a particular system element can, in some instances, be selected to accommodate the particular user needs.

In addition, those of ordinary skill in the art will appreciate that the embodiments of the invention described herein can be modified to accommodate and/or comply with changes and improvements in the applicable technology and standards referred to herein. Variations, modifications, and other implementations of what is described herein can occur to those of ordinary skill in the art without departing from the spirit and the scope of the invention as claimed.

The particular combinations of elements and features in the above-detailed embodiments are exemplary only; the interchanging and substitution of these teachings with other teachings in this and the referenced patents/applications are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by way of example only and is not intended as limiting. The invention's scope is defined in the following claims and the equivalents thereto.

Having described and illustrated the principles of the technology with reference to specific implementations, it will be recognized that the technology can be implemented in many other, different, forms, and in many different environments. The technology disclosed herein can be used in combination with other technologies. Having described the preferred embodiments of the invention, it will now become apparent to one of ordinary skill in the art that other embodiments incorporating their concepts may be used. These embodiments should not be limited to the disclosed embodiments, but rather should be limited only by the spirit and scope of the appended claims.

The invention claimed is:

1. A rocket propelled grenade (RPG) simulation device usable with a laser detector, the RPG simulation device comprising:

a first housing simulating at least one predetermined physical characteristic of an actual RPG device, the first housing coupled to a laser transmitter, an anti-tank weapons effect system simulator (ATWESS), a set of user controls, and a controller;

a dual-function laser assembly disposed within the first housing, the dual-function laser assembly comprising a dual-function laser housing within which first and second laser transmitters are disposed, wherein the first laser transmitter generates a laser alignment signal, upon receipt of a first control signal, and the second laser transmitter generates a laser simulation signal directed to the laser detector, upon receipt of a second control signal, the laser simulation signal comprising information readable by the laser detector to simulate a launch of a rocket propelled grenade from the RPG simulation device to the laser detector;

an ATWESS disposed within the first housing, the ATWESS activated upon receipt of a third control signal, wherein, upon activation the ATWESS generates an indicator replicating a physical effect that occurs when an RPG launches a grenade, the physical effect being perceivable external to the RPG simulation device so as to be perceivable to a person other than a user of the RPG simulation device, and wherein, if the third control signal is not received at the ATWESS, the ATWESS is not activated;

a set of user-accessible controls mounted to the first housing, the set of user-accessible controls comprising a first control enabling the user to trigger the laser alignment signal from the first laser transmitter, a second control enabling the user to trigger the laser simulation signal from the second laser transmitter from the controller, and a third user control enabling the user to set an operational mode for the RPG simulation device, wherein the operational mode is selected from at least a first operational mode in which the RPG simulation device produces a laser simulation signal with no physical effect and a second operational mode in which the RPG simulation device produces both a laser simulation signal and a physical effect;

a controller disposed within the first housing, the controller being in operable communication with the first and second laser transmitters, the ATWESS, and the set of user-accessible controls, the controller configured to automatically:

determine, based at least in part on the settings of the set of user-accessible controls and on whether either of the first and second controls has been triggered, whether or not to generate any one or more of the first, second, and third control signals, whether or not to generate a laser alignment signal, and whether or not to generate a laser simulation signal;

determine, based on the operational mode set via the third control, whether or not to activate the ATWESS when the second control signal is triggered to cause a laser simulation signal to be generated;

control the generation of the laser alignment signal;

control the generation and power level of the laser simulation signal, including, if required, hit and near miss laser power level adjustment;

set an encoding of the laser simulation signal; and simulate the launch of a rocket propelled grenade by generating and transmitting the laser simulation signal, wherein the simulating of the launch further comprises, if applicable based on operational mode set by the user, generation of the physical effect.

2. The RPG simulation device of claim 1, wherein the laser simulation signal comprises a pulse of laser energy.

3. The RPG simulation device of claim 1, wherein the indicator comprises at least one physical effect selected from the group consisting of a noise, a visual effect, a gaseous effect, muzzle flash, smoke, an audible effect, and a blast sound.

4. The RPG simulation device of claim 1, further comprising a display in communication with the controller, the display being coupled to the first housing, wherein the display is constructed and arranged to display information related to operation of the RPG simulation device to the user of the RPG simulation device.

5. The RPG simulation device of claim 4, where the information related to operation of the RPG comprises at least one piece of information selected from the group consisting of round count, player identification number, laser power level, rounds remaining, weapon type, and battery level.

6. The RPG simulation device of claim 1 further comprising a first indicator capable of indicating to the user that the laser simulation signal has been transmitted, the first indicator being coupled to the first housing.

7. The RPG simulation device of claim 1 further comprising a second indicator capable of enabling alignment of the laser transmitter, the second indicator being coupled to the first housing.

8. The RPG simulation device of claim 1, wherein the laser simulation signal comprises at least one code recognizable by the MILES-type detector.

9. The RPG simulation device of claim 1, wherein the controller performs at least one additional operation selected from the group consisting of: tracking number of rounds fired; tracking a player identification number, tracking a power level of the laser simulation signal; tracking a battery level; generating a programmable hit and near miss word, adjusting a power level of the laser simulation signal;; generating a signal to control the laser simulation signal where the laser simulation signal further comprises a MILES code; tracking MILES code related information in a laser simulation signal that comprises a MILES code; receiving an instruction from an external system via a first USB port; providing data to an external system via a second USB port; providing information to a display; providing reverse voltage protection; responding to a controller key; responding to a push to read switch; responding to a magnetic switch; responding to a trigger switch; and responding to a safety switch.

10. The RPG simulation device of claim 1, further comprising a simulated grenade coupled to at least a portion of the first housing.

11. The RPG simulation device of claim 1, wherein the first housing, together with the ATWESS and set of user-accessible controls, is constructed and arranged to simulate at least one predetermined characteristic of the weapon being simulated, the characteristic comprising at least one feature selected from the group consisting of look, feel, physical appearance, weight, color, shape, housing material, length, range, sound, muzzle flash, smoke, visual effect occurring when weapon is fired, audio effect occurring when weapon is fired, and gaseous effect occurring when weapon is fired.

12. A method for simulating operation of a rocket propelled grenade (RPG), comprising:

providing a physical structure having at least one predetermined characteristic in common with an actual RPG;

disposing a dual-function laser assembly within the physical structure, the dual-function laser assembly comprising a dual-function laser housing within which first and second laser transmitters are disposed, wherein the first laser transmitter is operable to generate a laser alignment signal upon receipt of a laser alignment control signal, and wherein the second laser transmitter is operable to generate a laser simulation signal to a laser detector upon receipt of a laser simulation control signal, the laser simulation signal simulating the launch of an RPG;

disposing an anti-tank weapons effect systems simulator (ATWESS) within the physical structure, the ATWESS operable to produce, upon receipt of an ATWESS control signal, a physical effect perceivable external to the physical structure;

providing a set of user-accessible controls disposed at least partially within the physical structure, the set of user controls comprising a laser simulation control enabling a user to trigger the laser simulation control signal, a laser alignment control enabling a user to trigger the laser alignment signal, and an ATWESS control enabling the user to determine whether or not to generate an ATWESS control signal so as to also trigger the ATWESS when the laser simulation signal is triggered;

determining, based at least in part on the settings of the set of user-accessible controls, whether or not to generate any one or more of the laser alignment control signal, the laser simulation control signals and the ATWESS control signals;

determining, based on the setting of the ATWESS control, whether or not to activate the ATWESS when the laser simulation control is set to cause a laser simulation signal to be generated;

controlling the generation and power level of the laser simulation signal, including, if required, changing the power level of the laser simulation signal and setting an encoding of the laser simulation signal;

controlling the generation of the laser alignment signal; and simulating the launch of an RPG rocket propelled grenade by generating and transmitting the laser simulation signal, wherein the simulating of the launch further comprises, if applicable generating the physical effect.

13. The method of claim 12 further comprising encoding the laser simulation signal with a MILES code.

14. The method of claim 12, wherein generating the physical effect further comprises generating at least one physical effect selected from the group consisting of sound, muzzle flash, smoke, visual effect, audio effect, and gaseous effect.

* * * * *